US012398511B2

(12) United States Patent
Luedecke

(10) Patent No.: US 12,398,511 B2
(45) Date of Patent: Aug. 26, 2025

(54) ARTICLES WITH EMBROIDERED SEQUINS IN VARIABLE PATTERNS

(71) Applicant: Under Armour, Inc., Baltimore, MD (US)

(72) Inventor: Tom Luedecke, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 787 days.

(21) Appl. No.: 17/476,613

(22) Filed: Sep. 16, 2021

(65) Prior Publication Data

US 2022/0002942 A1 Jan. 6, 2022

Related U.S. Application Data

(62) Division of application No. 15/852,093, filed on Dec. 22, 2017, now Pat. No. 11,149,382.

(60) Provisional application No. 62/443,501, filed on Jan. 6, 2017.

(51) Int. Cl.

| | |
|---|---|
| ***D06Q 1/10*** | (2006.01) |
| ***A41D 27/08*** | (2006.01) |
| ***A43B 3/00*** | (2022.01) |
| ***A43B 23/02*** | (2006.01) |
| ***A43D 8/16*** | (2006.01) |
| ***D05C 17/00*** | (2006.01) |

(52) U.S. Cl.

CPC ..... *D06Q 1/10* (2013.01); *A41D 27/08* (2013.01); *A43B 3/0078* (2013.01); *A43B 23/0235* (2013.01); *A43B 23/0245* (2013.01); *A43B 23/025* (2013.01); *A43B 23/0255* (2013.01); *A43B 23/026* (2013.01); *A43B 23/027* (2013.01); *A43B 23/029* (2013.01); *A43D 8/16* (2013.01); *D05C 17/00* (2013.01)

(58) Field of Classification Search

CPC ..... A41D 27/08; D06Q 1/10
USPC ..... 2/244
See application file for complete search history.

(56) References Cited

U.S. PATENT DOCUMENTS

| | | | |
|---|---|---|---|
| 4,026,047 | A | 5/1977 | Ahmer |
| 4,131,720 | A | 12/1978 | Spengler |
| 4,233,760 | A | 11/1980 | Haynes |
| 4,427,733 | A | 1/1984 | Poll et al. |

(Continued)

FOREIGN PATENT DOCUMENTS

| | | | |
|---|---|---|---|
| CN | 200994779 | Y | 12/2007 |
| CN | 201256654 | Y * | 6/2009 |

(Continued)

OTHER PUBLICATIONS

KR 101574787B1—Jun. 2010 KR Y—Yoo—translation.*

(Continued)

*Primary Examiner* — Alissa J Tompkins
*Assistant Examiner* — Catherine M Ferreira
(74) *Attorney, Agent, or Firm* — Maginot, Moore & Beck, LLP

(57) ABSTRACT

Hot melt sequins and methods of applying these sequins are disclosed. Sequins can be arranged in various patterns. Sequins can be arranged in dispersive patterns. Sequin patterns can be used to create gradients on the outside of an upper. The sequins can be used to attach two layers where the density of the sequins used to attach the layers can affect thermal properties, flexibility and relative motion between the layers.

10 Claims, 24 Drawing Sheets

(56) References Cited

U.S. PATENT DOCUMENTS

| | | | | |
|---|---|---|---|---|
| 4,890,362 | A | 1/1990 | Odajima et al. | |
| 4,944,072 | A * | 7/1990 | Robson | A44B 19/16 24/585.12 |
| 4,952,436 | A | 8/1990 | Ruschmann | |
| 5,323,650 | A | 6/1994 | Fullen et al. | |
| 5,482,196 | A | 1/1996 | Doyel | |
| 5,928,803 | A | 7/1999 | Yasuda | |
| 5,958,535 | A | 9/1999 | Desmet | |
| 6,179,879 | B1 | 1/2001 | Robinson et al. | |
| 6,233,845 | B1 | 5/2001 | Belli | |
| 6,301,044 | B1 | 10/2001 | Huber et al. | |
| 6,319,599 | B1 | 11/2001 | Buckley | |
| 6,767,850 | B1 | 7/2004 | Tebbe | |
| 7,112,362 | B2 | 9/2006 | Blonder | |
| 7,404,263 | B2 | 7/2008 | Guzman | |
| 7,426,873 | B1 | 9/2008 | Kholwadwala et al. | |
| 7,871,690 | B2 | 1/2011 | Ashikaga | |
| 7,952,239 | B2 | 5/2011 | Clark et al. | |
| 8,245,634 | B1 | 8/2012 | Malaro et al. | |
| 8,389,093 | B2 | 3/2013 | Collins | |
| 8,732,866 | B2 | 5/2014 | Genz et al. | |
| 9,003,618 | B2 | 4/2015 | Violato | |
| 9,014,838 | B2 | 4/2015 | Muto | |
| 9,095,185 | B1 | 8/2015 | Ortner | |
| 9,301,574 | B2 | 4/2016 | Smith, III | |
| 9,346,930 | B2 | 5/2016 | Abhari | |
| 2003/0156619 | A1 | 8/2003 | De Monte et al. | |
| 2003/0213044 | A1 | 11/2003 | Wilkinson et al. | |
| 2004/0033325 | A1 | 2/2004 | Shea et al. | |
| 2004/0069396 | A1 * | 4/2004 | Trosman | D06Q 1/12 156/276 |
| 2005/0005471 | A1 | 1/2005 | Pan | |
| 2005/0011087 | A1 | 1/2005 | Stevens | |
| 2005/0066866 | A1 | 3/2005 | Pederzini | |
| 2006/0254088 | A1 | 11/2006 | McCormick | |
| 2007/0130805 | A1 | 6/2007 | Brady et al. | |
| 2007/0199490 | A1 | 8/2007 | Suzuki | |
| 2008/0087206 | A1 | 4/2008 | Murase | |
| 2009/0126233 | A1 | 5/2009 | Rastegar et al. | |
| 2009/0203275 | A1 | 8/2009 | Dehn | |
| 2009/0274864 | A1 | 11/2009 | Tsai | |
| 2009/0297756 | A1 | 12/2009 | Dehn | |
| 2010/0205716 | A1 * | 8/2010 | Kim | B32B 7/12 428/34.1 |
| 2010/0307031 | A1 | 12/2010 | Granito | |
| 2010/0313806 | A1 | 12/2010 | Konig | |
| 2012/0017472 | A1 | 1/2012 | Burnstein | |
| 2012/0260838 | A1 * | 10/2012 | Matsuhiro | D05C 7/08 112/113 |
| 2013/0097893 | A1 | 4/2013 | Rabinovitch | |
| 2013/0288569 | A1 | 10/2013 | Gentry et al. | |
| 2014/0000126 | A1 | 1/2014 | Nelson-Warren | |
| 2014/0059819 | A1 | 3/2014 | Cleare et al. | |
| 2014/0059886 | A1 * | 3/2014 | Lyttle | A43B 1/00 156/283 |
| 2014/0259295 | A1 | 9/2014 | Guglielmo et al. | |
| 2015/0000165 | A1 | 1/2015 | Reiff | |
| 2015/0047104 | A1 | 2/2015 | Levine | |
| 2015/0265003 | A1 | 9/2015 | Lauria | |
| 2015/0331524 | A1 | 11/2015 | McMillen | |
| 2016/0007678 | A1 | 1/2016 | Silverman | |
| 2016/0021969 | A1 | 1/2016 | Lettow et al. | |
| 2016/0128404 | A1 | 5/2016 | Friedberg | |
| 2016/0192741 | A1 | 7/2016 | Mark | |
| 2016/0198799 | A1 | 7/2016 | Partin et al. | |
| 2016/0227880 | A1 | 8/2016 | Champagne et al. | |
| 2016/0252412 | A1 | 9/2016 | McMillen et al. | |
| 2016/0270478 | A1 * | 9/2016 | Doremus | D06M 23/16 |
| 2016/0331054 | A1 | 11/2016 | Coza et al. | |
| 2016/0335913 | A1 | 11/2016 | Grant et al. | |
| 2018/0192736 | A1 * | 7/2018 | Luedecke | A43B 23/0255 |
| 2018/0192743 | A1 | 7/2018 | Luedecke | |
| 2018/0195222 | A1 | 7/2018 | Luedecke | |

FOREIGN PATENT DOCUMENTS

| | | | |
|---|---|---|---|
| CN | 201911348 | U | 8/2011 |
| CN | 201911349 | U | 8/2011 |
| CN | 201929139 | U | 8/2011 |
| CN | 201931912 | U | 8/2011 |
| CN | 102409570 | A | 4/2012 |
| CN | 202386220 | U | 8/2012 |
| CN | 202566427 | U | 12/2012 |
| CN | 202664441 | U | 1/2013 |
| CN | 203105656 | U | 8/2013 |
| CN | 203472387 | U | 3/2014 |
| CN | 103704943 | A | 4/2014 |
| CN | 103829419 | A | 6/2014 |
| CN | 103832195 | A | 6/2014 |
| CN | 203754999 | U | 8/2014 |
| CN | 204370735 | U | 6/2015 |
| CN | 104988757 | A | 10/2015 |
| CN | 204820570 | U | 12/2015 |
| CN | 204820878 | U | 12/2015 |
| CN | 204845024 | U | 12/2015 |
| CN | 204845049 | U | 12/2015 |
| CN | 105639944 | A | 6/2016 |
| CN | 105661702 | A | 6/2016 |
| CN | 105667174 | A | 6/2016 |
| CN | 107097499 | A | 8/2017 |
| DE | 102012007602 | A1 | 10/2012 |
| EP | 370413 | B1 | 8/1993 |
| FR | 2856708 | A1 | 12/2004 |
| GB | 1325293 | A | 8/1973 |
| GB | 2421416 | A | 6/2006 |
| JP | 09228124 | A | 9/1997 |
| JP | 3167720 | U | 5/2011 |
| JP | 2012081141 | A | 4/2012 |
| KR | 101574787 | B1 * | 6/2010 |
| KR | 20130043363 | A | 4/2013 |
| KR | 200471289 | Y1 | 2/2014 |
| TW | 200838475 | A | 10/2008 |
| WO | 2010121810 | A1 | 10/2010 |
| WO | 201527234 | A2 | 2/2015 |
| WO | 2018/129146 | A1 | 7/2018 |

OTHER PUBLICATIONS

CN 201256654 Y Yajuan Jun. 2009—translation.*

KR 101574787B1—Jun. 2010 KR Y—Yoo—translation (Year: 2010).*

CN 201256654 Y Yajuan Jun. 2009—translation (Year: 2009).*

International Search Report and Written Opinion issued May 17, 2018 for International Application No. PCT/US2018/012330.

"Custom Number Paw Burst Iron on Rhinestone Transfer" (JCS Rhinestones) Aug. 11, 2016 (Aug. 11, 2016); retrieved from Internet Feb. 20, 2018; <https://web.archive.org/web/20160811200642/http://jubileerhinestones.com/custom-number-paw-burst-iron-on-rhinestone-transfer.html>.

"AIDAN03 Red Flat" (Wholesale Fashion Shoes) Apr. 5, 2015 (Apr. 5, 2015); retrieved from internet May 2, 2018; <URL=https://web.archive.org/web/20150405065429/http://www.wholesalefashionshoes.com/collections/size-6-5/products/aidan03-red-flat>.

"Silver Shimmer Beaded Pump Heels" (AMI Clubwear) Jul. 19, 2013 (Jul. 19, 2013); retrieved from internet Feb. 20, 2018; <https://web.archive.org/web/20130719235552/https://www.amiclubwear.com/shoes-heels-js-barby2silver.html>.

"Hot Melt Adhesives" (Technische Kommission Holzklebstoffe) Mar. 2015 (Mar. 2015); retrieved from internet Feb. 20, 2016; <http://www.klebstoffe.com/fileadmin/redaktion/ivk/Merkblaetter/TKH_4_englisch.pdf>.

"Iron on Transfer Instructions" (JCS Rhinestones) May 2, 2018 (May 2, 2018); retrieved from internet May 2, 2018; <URL=http://jubileerhinestones.com/iron-on-transfer-instructions/>.

* cited by examiner

ARTICLES WITH EMBROIDERED SEQUINS IN VARIABLE PATTERNS

REFERENCE TO RELATED APPLICATIONS

This application is a division of and claims priority to U.S. application Ser. No. 15/852,093, filed Dec. 22, 2017 and titled "Articles with Embroidered Sequins in Variable Patterns", which application claims priority to Luedecke, U.S. Provisional Application Ser. No. 62/443,501, filed Jan. 6, 2017, and titled "Articles with Embroidered Sequins and Methods of Making," the entirety of which applications are incorporated by reference herein.

BACKGROUND

Embroidery is a traditional method of decorating, tailoring, mending, patching, or reinforcing textile materials by sewing with a needle and stitching material. Hand-embroidered goods date back as late as the Warring States period in China. During the industrial revolution, the invention of the sewing machine and dedicated embroidery machines expanded the use of the technique. Modern embroidery techniques may utilize machine readable code to autonomously create an embroidery pattern on a sheet of textile materials. Textile materials include fabrics such as cotton, wool or silk, as well as leather, foam, polymer sheets, and synthetic equivalents. On the textile materials, a number of stitch techniques may be used (such as the chain stitch, the buttonhole or blanket stitch, the running stitch, the satin stitch, or the cross stitch), depending on the purpose of the embroidery. The stitching techniques may be used in combination to form a variety of set patterns. The stitching patterns may be decorative; for example, the pattern may form a flower or series of flowers. Alternatively, the stitching may be structural, such as stitching along the edges of a garment to reinforce the seams. In further cases, the stitching may be both decorative and functional, such as the use of a floral pattern used to reinforce a patch.

Typically, a thread or yarn is used as the stitching material and stitched into the textile. Commonly, the thread or yarn may be made of cotton or rayon, as well as traditional materials like wool, linen or silk. However, embroidery may also sew in dissimilar materials to the textile, usually for decorative purposes. For example, thread created out of precious metals such as gold or silver may be embroidered within more traditional fabrics such as silk. Additional elements may be sewn in during embroidery, such as beads, quills, sequins, pearls, or entire strips of metal. These elements may be sewn in along with yarn or thread using a variety of stitching techniques, depending on the desired placements of the elements.

SUMMARY

In one aspect, an article includes a plurality of sequins attached to article. Each sequin in the plurality of sequins is comprised of a hot melt material. The plurality of sequins is arranged in a dispersive pattern such that a first group of sequins in the dispersive pattern are closer together than a second group of sequins in the dispersive pattern.

In another aspect, an article includes a first layer of the article and a second layer of the article, a first set of hotmelt sequins bonding the first layer to the second layer in a first region of the article, and a second set of hotmelt sequins bonding the first layer to the second layer in a second region of the article. The first set of hotmelt sequins are more densely arranged than the second set of hotmelt sequins.

In another aspect, method of making an article includes embroidering a plurality of hotmelt sequins to a first layer, where a first set of hotmelt sequins are embroidered in a first region according to a first sequin pattern and where a second set of hotmelt sequins are embroidered in a second region according to a second pattern. Placing a second layer against the first layer and heating the plurality of hotmelt sequins to bond the first layer to the second layer.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, with emphasis instead being placed upon illustrating the principles of the embodiments. Moreover, in the figures, like reference numerals designate corresponding parts throughout the different views.

DETAILED DESCRIPTION

Figure 1:
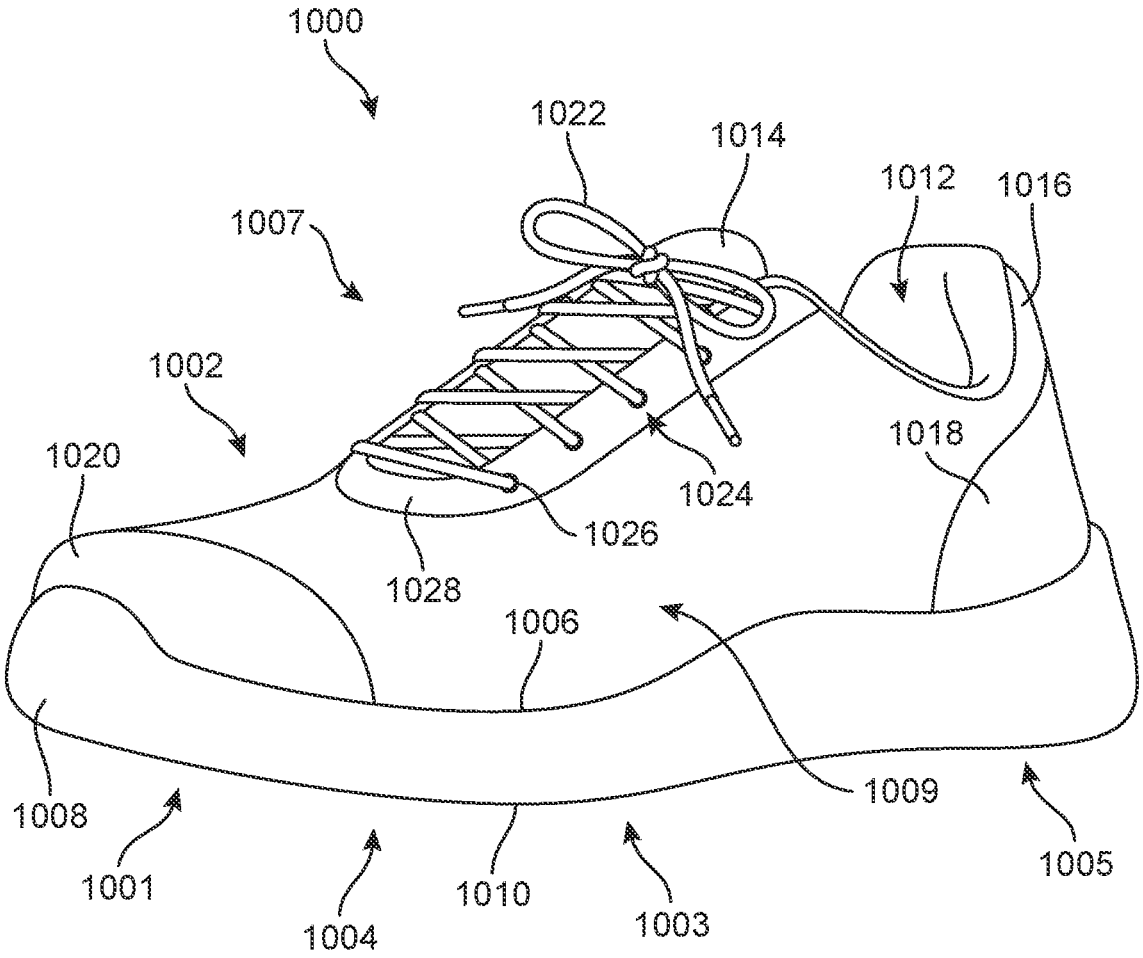
FIG. 1 is a schematic isometric view of an embodiment of an article of footwear.

In the following detailed description, reference is made to the accompanying figures that form a part hereof, wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic or may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure are synonymous.

The embodiments are related to the application of one or more sequins to an article. As used herein, the term "article" refers broadly to articles of footwear, articles of apparel (e.g., clothing), as well as accessories and/or equipment. Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

For purposes of general reference, as illustrated in FIG. 1, article of footwear 1000 may be divided into three regions: forefoot region 1001, midfoot region 1003, and heel region 1005. Forefoot region 1001 may be generally associated with the toes and joints connecting the metatarsals with the phalanges. Midfoot region 1003 may be generally associated with the arch of a foot, including the instep. Likewise, heel region 1005 or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from forefoot region 1001 to heel region 1003 of article of footwear 1000. The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between medial side 1007 and lateral side 1009 of article of footwear 1000, with lateral side 1009 of article of footwear 1000 being the surface that faces away from the other foot, and medial side 1007 being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The term "side," as used in this specification and in the claims, refers to any portion of a component facing generally in a lateral, medial, forward, or rearward direction, as opposed to an upward or downward direction. The term "lateral side" refers to any component facing in general toward the lateral direction. The term "medial side" refers to any component facing in general toward the medial direction.

It will be understood that the forefoot region, the midfoot region, and the heel region are only intended for purposes of description and are not intended to demarcate precise regions of an article of footwear. For example, in some cases, one or more of the regions may overlap. Likewise, the medial side and the lateral side are intended to represent generally two sides, rather than precisely demarcating an article of footwear into two halves. In addition, the forefoot region, the midfoot region, and the heel region, as well as the medial side and the lateral side, may also be applied to individual components of an article of footwear, including a sole structure, an upper, a lacing system, and/or any other component associated with the article.

Article of footwear 1000 may include upper 1002 and sole or "sole structure" 1004, which define an internal cavity between the upper and sole. The "interior" of an article of footwear refers to space in this internal cavity that is occupied by a wearer's foot when the article of footwear is worn. The "inner side" or "inside" of an element refers to the face of that element that is (or will be) oriented toward the internal cavity in a completed article of footwear. The "outer side," "outside," or "exterior" of an element refers to the face of that element that is (or will be) oriented away from the internal cavity in the completed article of footwear 1000. In some cases, the inner side of an element may have other elements between that inner side and the interior in the completed article of footwear 1000. Similarly, an outer side of an element may have other elements between that outer side and the space external to the completed article of footwear 1000. Further, the terms "inward" and "inwardly" shall refer to the direction toward the interior of the article of footwear, and the terms "outward" and "outwardly" shall refer to the direction toward the exterior of article of footwear 1000.

Upper 1002 provides a covering for the wearer's foot that comfortably receives and securely positions the foot with respect to the sole structure. Upper 1002 may be made from any suitable material or pluralities of materials, including but not limited to, for example, nylon, cotton, natural leather, synthetic leather, natural rubber, or synthetic rubber. In general, upper 1002 includes opening 1012 that provides entry for the foot into an interior cavity of the upper in heel region 1005. Upper 1002 may be of a variety of styles, depending on factors such as desired use and required ankle mobility, for example, an athletic shoe with upper 1002 having a "low-top" configuration extending below the ankle that is shaped to provide high mobility for an ankle. However, upper 1002 could be configured as a "high-top" upper extending above the wearer's ankle for basketball or other activities, or as a "mid-top" configuration extending to about the wearer's ankle. Furthermore, upper 1002 may also include non-athletic shoes, such as dress shoes, loafers, sandals, and work boots. Upper 1002 may also include tongue 1014 that provides cushioning and support across the instep of the foot. Upper 1002 may also include collar 1016 within opening 1012, collar 1016 may include an elastomeric or tacky material to allow the opening to stretch and conform to the wearer's ankle. Upper 1002 may include heel counter 1018. Heel counter 1018 may be disposed over upper 1002's outer surface or within the upper on upper 1002's interior surface. Upper 1002 may also include other known features in the art including heel tabs, loops, etc. Furthermore, upper 1002 may include toe cage or box 1020 in the forefront region. Even further, upper 1002 may include logos, trademarks, and instructions for care. Upper 1002, and the components for upper 1002 may be manufactured from conventional materials (e.g., woven or non-woven textiles, leather, synthetic leather, rubber, polymer foams, etc.). The specific materials utilized are generally selected to impart wear resistance, flexibility, air permeability, moisture control, and comfort to the article of footwear.

Upper 1002 may include a fastening provision on a fastening region of the upper. For example, the fastening provision may be lacing system 1022, or "lace" applied at a fastening region of upper 1002. Other embodiments of fastening provisions, include, but are not limited to, laces, cables, straps, buttons, zippers as well as any other provisions known in the art for fastening articles. For a lacing system, the fastening region comprises plurality of eyelets 1024 on the upper comprised of a series of individual eyelets 1026 on medial side 1007 and lateral side 1009 of upper 1002 extending up to collar 1016 in upper 1002. Additionally, the lacing system may include lace cage 1028. In other embodiments, the fastening region may comprise one or more tabs, loops, hooks, D-rings, hollows, or any other provisions known in the art for fastening regions.

Sole structure 1004 is positioned between a foot of a wearer and the ground, and may incorporate various component elements. For example, sole structure 1004 may include one or more of inner sole component or "insole" 1006, a middle sole element or "midsole" 1008, and an outer sole element or "outsole" 1010. Insole 1006 may take the form of a sockliner adjacent the wearer's foot to provide a comfortable contact surface for the wearer's foot. It will be understood that an insole may be optional. Further, midsole 1008 may directly serve as a cushion and support for the foot. In addition, outsole 1010 may be configured to contact the ground surface. Insole 1006, midsole 1008, and outsole 1010 may be assembled together with insole 1006 forming the interior of sole structure 1004, while outsole 1010 forms the exterior. Insole 1006, midsole 1008, and outsole 1010 may be combined into a single structure. Upper 1002 and sole structure 1004 may be coupled using any conventional or suitable manner, such as adhesion or bonding, via a woven connection, via one or more types of fasteners, etc. Additionally, sole structure 1004 and upper 1002 may be combined together in a single unitary construction.

Sole structure 1004 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portions of sole structure 1004 may include provisions for traction, including, but not limited to, traction elements, studs, and/or cleats. In some cases, outsole 1010 is secured to a lower surface of midsole 1008. It will be understood that in other embodiments, outsole 1010 may be optional. For example, midsole 1008 may be configured to contact the ground surface directly. Furthermore, midsole 1008 could be provided with various traction elements, studs, and/or cleats to contact the ground surface. Additionally, portions of both midsole 1008 and outsole 1010 can be configured to contact a ground surface.

Sole structure 1004 may be made of a variety of any suitable material or pluralities of materials for a variety of functions. For example, one or more components of sole structure 1004, such as the midsole, may be formed from a polymer foam (e.g., a polyurethane or ethylvinylacetate foam) material that attenuates ground reaction forces (i.e., provides cushioning) during walking, running, and other ambulatory activities. In addition, the components of a sole may also include gels, fluid-filled chambers, plates, moderators, inserts, or other elements that further attenuate forces, enhance stability, or influence the motions of the foot. In addition, the other components may have specific surface properties, such as an outsole being made from a durable material, such as carbon or blown rubber, which is further textured to impart traction. Furthermore, the insole may be made from a waterproof material such as a synthetic like ethylvinylacetate to prevent moisture seeping into the sole.

Dissimilar materials described herein may be attached by fusing or welding. As utilized herein, the terms "fusing" and "welding" (and variants thereof) are defined as a securing technique between two elements that involves a softening or melting of the material of at least one of the elements such that the materials of the elements are secured to each other when cooled. Similarly, the term "weld" or variants thereof is defined as the bond, link, or structure that joins two elements through a process that involves a softening or melting of material within at least one of the elements such that the elements are secured to each other when cooled. Welding may involve the melting or softening of two components such that the materials from each component intermingle with each other, that is, the materials may diffuse across a boundary layer (or "heat-affected zone") between the materials, and are secured together when cooled. Alternatively, welding may involve the melting or softening of a material in a first component such that the material extends into or infiltrates the structure of a second component, for example, infiltrating crevices or cavities in the second component or extending around or bonding with filaments or fibers in the second component to secure the components together when cooled. Thus, welding of two components together may occur when material from one or both of the components melts or softens. Accordingly, a weldable material, such as a polymer material, may be provided in one or both of the components. Additionally, welding does not generally involve the use of stitching or adhesives, but involves directly bonding components to each other with heat. In some situations, however, stitching or adhesives may be utilized to supplement the weld or the joining of the components through welding. Components that have been welded together will be understood to be "fused" together.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

As used herein, the term "sequin" refers to any small element that may be attached to an article. In some embodiments, a sequin is a disc-shaped element with a central hole. However, the term sequin as used herein, is not intended to be limited to elements with a central hole. In some embodiments, for example, sequins may have holes that are off center (which may also be referred to as spangles). Moreover, the term sequin may also be used interchangeably with spangles, paillettes, or diamantes, which are all generally small (sometimes decorative) elements attached to an article.

The term "strand" includes a single fiber, filament, or monofilament, as well as an ordered assemblage of textile fibers having a high ratio of length to diameter and normally used as a unit (e.g., slivers, roving, single yarns, plies yarns, cords, braids, ropes, etc.).

The term "fiber" as used herein refers to a fundamental component used in the assembly of yarns and fabrics. Generally, a fiber is a component that has a length dimension that is much greater than its diameter or width. This term includes ribbon, strip, staple, and other forms of chopped, cut, or discontinuous fiber and the like having a regular or irregular cross section. "Fiber" also includes a plurality of any one of the above or a combination of the above. Examples of materials that may be utilized include cotton, polyester, nylon, polypropylene, polyethylene, acrylics, wool, acetate, polyacrylonitrile, and combinations thereof.

Natural fibers also include cellulosic fibers (e.g., cotton, bamboo) or protein fibers (e.g., wool, silk, and soybean).

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean shaped or others.

The term "yarn" as used herein refers to a continuous strand of textile fibers, filaments or material in a form suitable for weaving, or otherwise intertwining to form a textile fabric. Yarn can occur in a variety of forms to include a spun yarn containing staple fibers usually bound together by twist; a multifilament yarn containing many continuous filaments or strands; or a monofilament yarn that consists of a single strand.

The term "composite yarn" refers to a yarn prepared from two or more yarns (or "ends"), which can be the same or different. Composite yarn can occur in a variety of forms wherein the two or more ends are in differing orientations relative to one another, so long as the final composite yarn containing the two or more ends is stably assembled (i.e., will remain intact unless forcibly separated or disassembled). The two or more ends can, for example, be parallel, wrapped one around the other(s), twisted together, or combinations of any or all of these, as well as other orientations, depending on the properties of the composite yarn desired.

The embodiments may generally use any of the methods, techniques, processes, systems, machines, and/or equipment disclosed in Berns et al., U.S. Publication Number 2016/0316856, published Nov. 3, 2016, and titled "Footwear Upper Including Strand Layers"; Berns et al., U.S. Publication Number 2016/0316855, published Nov. 3, 2016, and titled "Footwear Upper Including Variable Stitch Density"; and Berns et al., U.S. Publication Number 2015/0272274, published Oct. 1, 2015, and titled "Footwear Including Textile Element," the entirety of each application being herein incorporated by reference.

The embodiments described in this application can make use of various methods, techniques, processes, systems, machines, and/or equipment for applying a sequin to an article, fabric, textile, foams, or other substrate or base layers. In some embodiments, these methods can include stitching one or more sequins to a substrate. In some embodiments, these methods can include embroidering one or more sequins to a substrate. In other embodiments, sequins can be attached using other methods.

For example, embodiments of the present disclosure could use any of the methods, techniques, processes, systems, machines, and/or equipment for applying sequins to an article as disclosed in Muto, U.S. Pat. No. 9,014,838, issued Apr. 21, 2015, and titled "Sewing Machine, Apparatus, and Non-transitory Computer-readable Medium Storing Computer Readable Instructions," the entirety of which is herein incorporated by reference. See, for example, sewing machine 1 shown in FIG. 1 of the Sewing Machine, Apparatus, and Non-transitory Computer-readable Medium Storing Computer Readable Instructions reference, which further includes an embroidery unit 2 that is mounted onto bed 11 of the sewing machine 1. Sewing machine 1 is capable of implementing a sequin sewing process to stitch one or more sequins in place.

Embodiments can also make use of any of the methods, techniques, processes, systems, machines, and/or equipment for controlling the delivery, placement, and/or stitching of sequins as disclosed in any of the following: Ochsner, U.S. Pat. No. 3,390,650, issued Jul. 2, 1968, and titled "Decorating Attachment For Embroidery Machine"; Gunther et al., U.S. Pat. No. 5,755,168, issued May 26, 1998, and titled "Sequin Delivery System for Embroidery and/or Sewing Machines"; Tajima et al., U.S. Pat. No. 7,082,884, issued Aug. 1, 2006, and titled "Sequin Feeder"; Murase, U.S. Publication Number 2008/0087206, published Apr. 17, 2008, and titled "Sequin Feeder Apparatus and Sewing Machine Capable of Sewing Sequins," the entirety of each of these applications being herein incorporated by reference.

Some embodiments may use other methods for creating and/or applying sequins to a substrate. As an example, embodiments could use any of the methods, techniques, processes, systems, machines, and/or equipment for forming and fixing sequins to a substrate as disclosed in Pollak et al., U.S. Pat. No. 4,623,411, issued Nov. 18, 1986, and titled "Method and Apparatus for Producing and Attaching Sequins," the entirety of which is herein incorporated by reference. The embodiments may also use any of the methods, techniques, processes, and/or systems disclosed in Luedecke, U.S. patent application Ser. No. 15/795,523, filed Oct. 27, 2017, the entirety of which is herein incorporated by reference.

Figure 2:
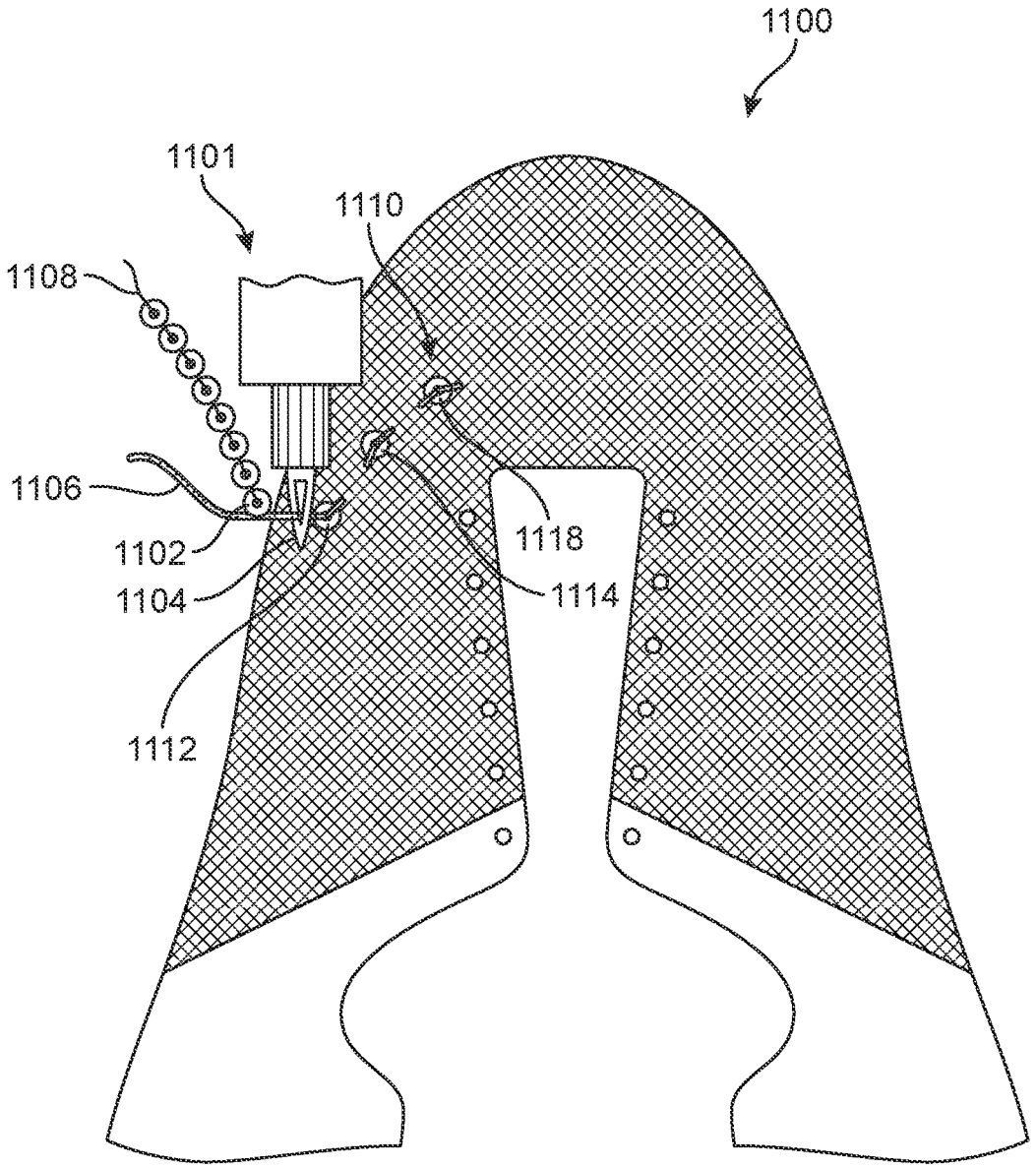
FIG. 2 is a schematic view of a step in a process for stitching sequins to an article, according to an embodiment.
Figure 3:
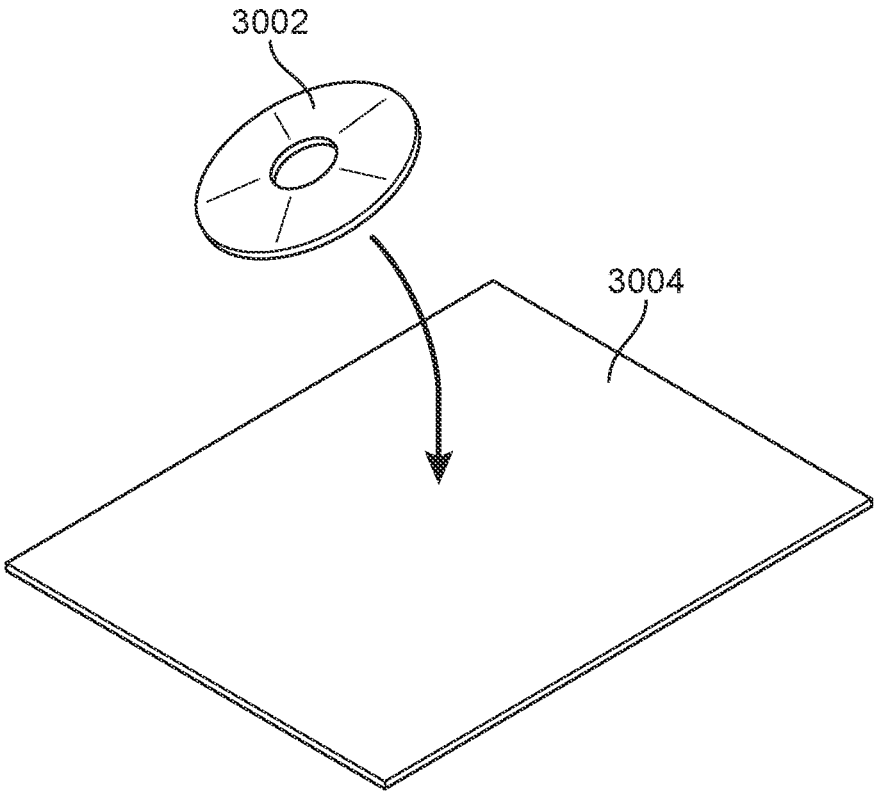
FIG. 3 is a schematic view of a hot melt sequin and a substrate material, according to an embodiment.
Figure 4:
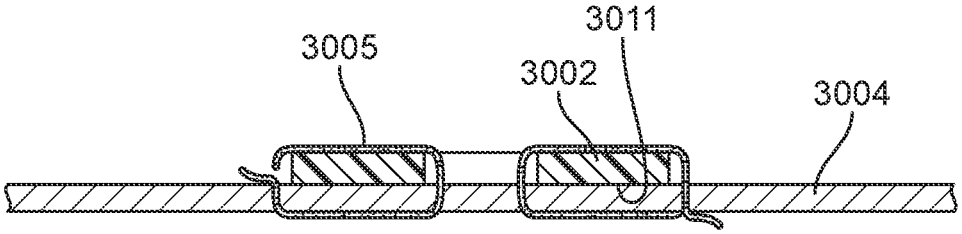
FIG. 4 is a schematic view of a step in a process for joining to textile layers using the hot melt sequin of FIG. 3.
Figure 5:
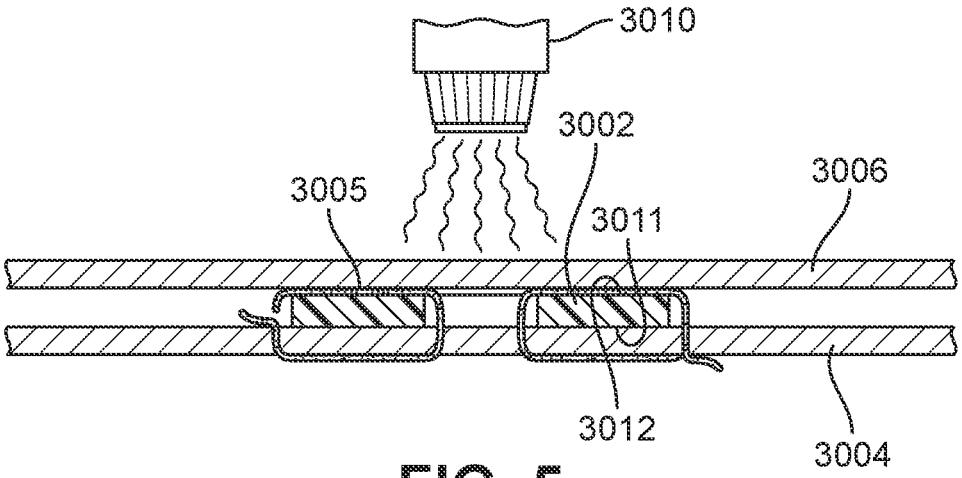
FIG. 5 is a schematic view of a step in a process for joining two textile layers using the hot melt sequin of FIG. 3, in which the hot melt sequin is heated.
Figure 6:
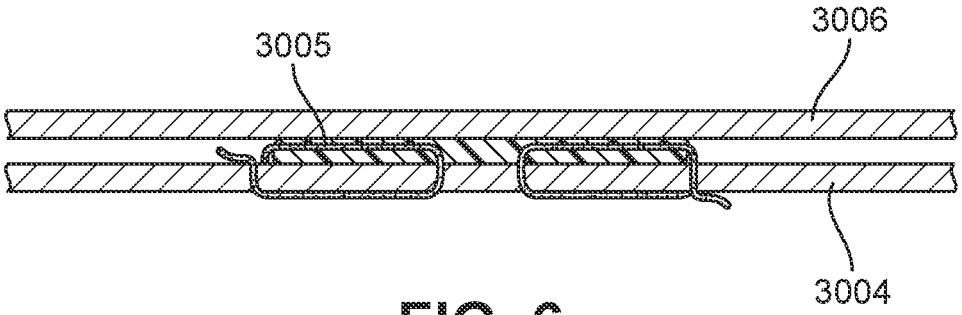
FIG. 6 is a schematic view of a step in a process for joining to textile layers using the hot melt sequin of FIG. 3, in which the hot melt sequin has melted and adhered to the two textile layers.

FIG. 2 demonstrates an exemplary embodiment of a method of embroidering sequins on to article 1100, also known as "the article". In some embodiments, the article of apparel may be an article of footwear, or an element of an article of footwear, such as the upper. In other embodiments, the article may be clothing, such as pants, socks, shirts, jackets, dresses, skirts, underwear, brassieres, supportive athletic garments, shorts, vests, or any other form of clothing known in the art. In still other embodiments, the article may be an accessory worn by a user such as hats, gloves, and bags, or any other accessory known in the art. In the specific illustrated example of FIG. 1, article 1100 is an upper for an article of footwear.

Article 1100 includes at least an element made of a textile. In some embodiments, the textile is a fabric made of material such as silk, wool, or cotton. In other embodiments, the textile is made of synthetic equivalents, such as polyvinyl acetate (PVA), thermoplastic polyurethane (TPU), or ethylene vinyl acetate (EVA). In general, a fabric comprises a series of yarns, fibers, filaments, or strands in a networked pattern made by weaving, knitting, spreading, crocheting, or bonding the yarns, fibers, filaments, or strands together. In still other embodiments, the textile may be leather, foam, synthetic equivalents of leather, or single-sheet materials such as plastic or vinyl sheets. In still further embodiments, article 1100 may be a backing layer comprised of a material able to dissolve or melt as needed, such as TPU, PVA, or EVA.

In sequin embroidery, a sequin is sewn to the textile using a thread and needle to stitch a sequin to a textile element of article 1100. As illustrated in FIG. 2, sequin 1102 may be embroidered by sewing sequin 1102 with needle 1104 and thread 1106 to a textile element of article 1100. Thread 1106 may be any form of strand, yarn, fiber filament, or strand mentioned herein including materials such as PVA, EVA, or TPU. Needle 1104 may be a hand needle or machine needle. In some embodiments, the embroidery is done using embroidery machine 1101. Generally, the machine and method of embroidering can be selected from any machines and methods disclosed in the applications cited.

The method of stitching used to attach one or more sequins may vary. In some embodiments, the sequin is stitched via an opening in the sequin. In other embodiments, the sequin is stitched through the sequin material. In some embodiments, an embroidery machine stitches thread using a needle via openings in the fabric comprising an article. In other embodiments, the needle creates its own opening in the article and stitches the sequin and thread via the resulting holes.

During the stitching process an initial stitch pierces article 1100 or an opening in the weave of the fabric of article. A sequin is then threaded on to thread 1106 by embroidery machine 1101 from continuous feed 1108 of sequins, and secured to article 1100 by a second backer stitch closing a loop of thread 1106 through article 1100. In some embodiments, each individual sequin is individually stitched to the textile. In other embodiments, multiple sequins may be stitched to the textile as a group. In still other embodiments, multiple sequins may come from multiple feeds and be stitched together as a group. In yet another embodiment, a combination of single sequin stitching and multiple sequin stitching may be used.

The technique of stitching the sequin to the article may vary. In some embodiments, the techniques or stitches used may include chain stitch, double chain stitch, the buttonhole or blanket stitch, the running stitch, the satin stitch, the cross stitch, or any other stitch technique known in the art. In other embodiments, a combination of known stitch techniques may be used. In further embodiments, these techniques may be used individually or in combination to stitch either individual sequins or groups of sequins to the article. In still further embodiments, these techniques may be used individually or in combination to stitch a combination of individual sequins and groups of sequins to the article.

The stitches may form a pattern. This pattern may take the form of individual sequins or groups of sequins or a combination of individual sequins and groups of sequins. When the stitching is performed by a machine, the machine may use a computer-generated program to control the stitching, including the locations of the stitching relative to the textile, as well as how and which sequins to feed, how to stitch the sequins, and the technique of stitching used. In the illustrated embodiment of FIG. 2, individual sequins comprising sequin 1112, sequin 1114, and sequin 1118 (collectively sequins 1110) are sewn to article 1100 in a pattern forming a line. In other embodiments, the pattern may comprise a curve, ovals or other geometric shapes or combination of shapes, characters such as letters or numbers, symbols such as a trademark, as well as additional patterns disclosed herein. In some embodiments, the thread may continuously stitch the article with sequins being inserted only where required by the pattern. In other embodiments, the thread may be discontinuous between sequins within the pattern.

In alternative embodiments, the sequin may also be attached to the textile via sequin crocheting, sequin knitting, or sequin weaving in addition to, or in place of sequin embroidery, either by hand or by using a machine such as an embroidery machine.

A backing layer, or backer layer, may be used during the embroidery process. A backing layer, in general, provides a layer behind article 1100 to give the embroidery machine a better working surface. In some embodiments, the backing layer holds article 1100 in place. In other embodiments, the backing layer provides an inner layer for the wearer to prevent itching or abrasion. In further embodiments, the backing layer may prevent an elastic or otherwise stretchable material from distorting during processing. In some embodiments, the backing layer is permanently attached to article 1100. In other embodiments, the backing layer is removable. In still other embodiments, the backing layer may be dissolved from the article. In further embodiments, the backing layer may be melted into the article. In some embodiments, the backing layer is a single piece. In other embodiments, the backing layer requires multiple pieces each with varying characteristics.

In different embodiments, the geometry of a sequin may vary. Sequins may have various geometric shapes including, but not limited to, rounded shapes, elliptic shapes, circular or disc-like shapes, regular polygon shapes (e.g., triangular shapes, rectangular shapes, pentagonal shapes, hexagonal shapes, etc.), irregular shapes or any other shapes. In some embodiments, a sequin may include a hole. In some cases, the hole could be a central hole providing the sequin with an annulus geometry. In other embodiments, sequins could have two or more holes. In some cases, a hole could be disposed closer to an edge of the sequin, in which case the sequin is often referred to as a spangle. Still other embodiments may not include any holes. In some cases, a sequin could be made of a material that is soft enough to be stitched through, without requiring a separate pre-formed hole.

In some embodiments, sequins could have a flat or smooth surface. In other embodiments, sequins may be faceted.

In different embodiments, the size of a sequin may vary. In some embodiments, a sequin may have an approximately two-dimensional shape, with a thickness that is less than a length and width of the sequin. In other embodiments, a sequin could have a thickness substantially similar to, or greater than, its length and/or width. Absolute sizes for a sequin could vary. In some embodiments, a sequin could have a length and/or width (or diameter) in a range between 1 mm and 20 mm.

In different embodiments, the materials comprising a sequin may vary. Exemplary materials that can be used in sequins include, but are not limited to, metals (e.g., gold, silver, bronze, etc.), acrylics, ceramic, rubber, as well as various kinds of polymers. In some embodiments, the material may be of a polymer material of varying hardness such as polyvinyl acetate (PVA), thermoplastic polyurethane (TPU), polyethylene, or ethylene vinyl acetate (EVA). In other embodiments, the sequins may be rigid materials such as ceramic or acrylic. In some embodiments, the sequin may be a blend of a polymer material with an additive such as nitrile rubber, such as an EVA blend with nitrile rubber. In some embodiments, the sequins may be made of a blended material such that the hardness may be controlled by the relative blend of nitrile rubber. In other embodiments, the relative hardness may be controlled by controlling the relative weights of various materials comprising the sequin, including the relative weights of PVA, TPU, and/or EVA as well as nitrile rubber. In still other materials, a combination of sequin materials may be used, including combining ceramic or acrylic sequins with polymer or polymer blend sequins. In some embodiments, the polymer or polymer blend material is fusible or weldable. In some embodiments, the polymer or polymer blend material is in foam form.

Some embodiments may include sequins comprised of materials including at least one hot melt material. A hot melt material, or hot melt adhesive material, may be any material that may be melted and is tacky when hot. Hot melt materials may be provided in solid form. Once heated, a hot melt material becomes tacky and bonds with other materials.

Exemplary materials that may be used as part of a hot melt material include, but are not limited to, ethylene-vinyl acetates, polyolefins, polyamides and polyesters, polyurethanes, styrene block copolymers, polycarbonates, fluoropolymers, silicone rubbers, etc. In some embodiments, a hot melt material could include, or consist of, thermoplastic polyurethane (TPU). Moreover, it may be appreciated that a hot melt material could comprise various combinations of the materials listed here, as well as combinations with still other materials. The specific materials used may be selected to achieve desired properties, such as a desired glass transition temperature, degree of crystallization, melt viscosity, crystallization rate, desired level of tackiness, color, resistance to water or other solvents, as well as possibly other factors.

It may be appreciated that a hot melt material can be used as an adhesive in some cases, or as a compound that can be molded with heat in other cases.

In various embodiments, the sequins may be made from a foam. In certain embodiments, the sequins are made from a polymer or polymer blend by mixing pellets of the polymer into a sequin maker, melting the pellets, and blowing the melt to form foam into the desired shape. The blown shape may be any shape known in the art. In some embodiments, the sequins are not blown. In further embodiments, the sequins may be blown to the same size regardless of the amount of pellets used, allowing pellet weight to control sequin density as well as hardness. For example, using fewer pellets may decrease the sequin density and relative hardness of the sequin, while using more pellets may increase the sequin density and relative hardness of the sequin. In some embodiments, the sequins may be partially blown rather than blown to the full size. For partially blown sequins, the sequin may be as much as 95% blown. In other embodiments, the sequins are not blown at all. In some embodiments, the sequins may be blown after the melt has begun to cool, while in other embodiments the sequins are melted immediately. In some embodiments, all foam sequins are of identical hardness and density and of a consistent degree of blowing. In other embodiments, the foam sequins may be a mixture of various hardnesses and densities as well as degree of blowing. Blowing the sequin may affect the ability to melt or fuse, as well as the density and hardness.

Threads used for embroidery may be used from a variety of materials. For example, thread may be made of polymer materials including nylon, polyethylene, TPU, PVA, or EVA as well as Dyneema fiber made from Ultra-High Molecular Weight Polyethylene. Thread may also include a blend of polymer materials and may include nitrile rubber. Thread also may be made from more conventional materials including cotton, silk, or other natural fibers disclosed herein. Thread also may be made from any known synthetic equivalent. In some embodiments, exposing the thread to heat or pressure may cause the thread to melt or fuse. In other embodiments, exposing the thread to heat or pressure may cause the thread to dissolve. In still other embodiments, the thread may dissolve when exposed to a solvent, such as acid or water.

It may be appreciated that in some embodiments, a hot melt sequin could be cured by the additional application of ultraviolet light and/or the use of additional chemical additives.

The materials of backing layers may vary. Backing sheets may be used as an anti-abrasion layer, and be made of a material that is soft to the skin, such as silk or cotton, as well as synthetics like equivalents such as nylon, or foam materials. Backing sheets may be used to prevent an article from stretching during embroidery, and be used from a harder more rigid substance, such as a sheet made from TPU, PVA, or EVA. Backing layers may also be made from a fusible material such as EV, or a dissolvable material such as TPU, PVA, or EVA. Furthermore, backing sheets may combine various materials for different purposes for a different section. For example, a rigid dissolvable backing material may be used in combination with a soft permanent backing layer.

Embodiments may use sequins to deliver a predetermined volume of adhesive material to a predetermined location on an article. In some embodiments, a sequin can be made of a material including an adhesive or bonding material. Examples include hot melt materials that can be used to adhere two or more components together. Different embodiments could use any kind of hot melt material or other kinds of adhesive materials. Examples include any of the materials described previously in this application. In one embodiment, the hot melt material could be thermoplastic polyurethane (TPU).

FIGS. 3-6 illustrate schematic views of steps in a process for bonding two fabric (or textile) layers together, according to an embodiment. Specifically, sequin 3002 is associated with first fabric layer 3004 and may be subsequently attached to first fabric layer 3004 using, for example, any of the methods described in this application (e.g., embroidering stitches 3005 (see FIG. 4)). Specifically, first side 3011 of sequin 3002 is disposed (and stitched) against a surface of first fabric layer 3004 (see FIG. 4). In this embodiment, sequin 3002 may comprise a material including TPU, or another hot melt material. Next, second fabric layer 3006 is laid over first fabric layer 3004 and sequin 3002 (as in FIG. 5), so that sequin 3002 is in contact with both layers (i.e., disposed between them). Specifically, second side 3012 of sequin 3002 (where second side 3012 is opposite of first side 3011) is in contact with a surface of second fabric layer 3006. Heat (in the form of heating apparatus 3010) may then be applied to heat and melt sequin 3002. Once melted, sequin 3002 may bond to first fabric layer 3004 and second fabric layer 3006, thus fixing them together once sequin 3002 has cooled.

It may be appreciated that in different embodiments, heat and/or pressure could be used to melt a hot melt sequin. In some embodiments, a standalone heating device could be used. In other embodiments, a heated press could be used to heat and apply pressure to bond materials with a hot melt sequin. Other embodiments could use any other methods known in the art for melting TPU or hot melt materials for purposes of bonding two or more layers or elements together.

The embodiment depicts bonding two layers; however, it may be appreciated that this method could be used to bond any number of layers of fabric or other kinds of textiles together. Moreover, this method could be used to bond a fabric or textile layer (to which a sequin may be stitched) with any other component that is bond compatible with TPU or another hot melt material.

It may be appreciated that in some cases, after a sequin has been heated, the sequin material may directly bond with the underlying fabric or substrate. In some cases, this bond may secure the sequin in place. In other cases, the heated sequin may not bond directly with the underlying fabric and instead may continue to be attached via stitches that remain to secure the melted sequin and the fabric. Of course, it may be appreciated that in some cases the sequin may both bond with the fabric and may also be secured by one or more stitches simultaneously.

In different embodiments, sequins could be attached to the outer and/or inner sides of a layer of material. In some embodiments, sequins could be attached to the inner side of an article to provide bonding areas for attaching an inner layer or inner element in an article. In other embodiments, sequins could be attached to the outer side of an article to provide bonding areas for attaching additional layers or other elements to the exterior of an article. Examples of external components that could be bonded to an article of footwear using hot melt sequins include, but are not limited to, counters, toe covers, lace cages, eyelets, lacing reels, sensors, as well as other structures, components or devices. Additionally, the hot melt sequins could be used to bond other threads, cords, or similar elements to a layer of an article.

Figure 7:
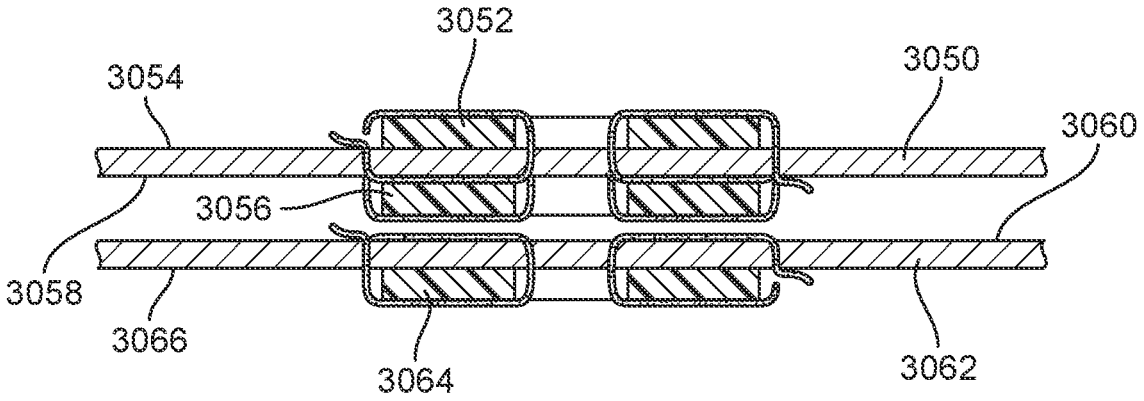
FIG. 7 is a schematic view of an embodiment of hot melt sequins used on the outermost, inner most, and interior surfaces of a dual-layer construction.

FIG. 7 illustrates a schematic view of two layers associated with sequins on various sides, according to an embodiment. Referring to FIG. 7, first layer of fabric 3050 may have first set of sequins 3052 stitched to first side 3054 of the layer and second set of sequins 3056 stitched to second side 3058 of the layer. Third set of sequins 3064 may be stitched to second side 3066 of second fabric layer 3062, to facilitate attachment with another element on second side 3066. In some embodiments, second set of sequins 3056 may be disposed against first side 3060 of second fabric layer 3062, thus allowing the two fabric layers to be joined when second set of sequins 3056 are heated. Moreover, an external component could be joined to first side 3054 of first layer of fabric 3050 by heating first set of sequins 3052, while an internal component could be joined to second side 3066 of second fabric layer 3062 by heating third set of sequins 3064.

Figure 8:
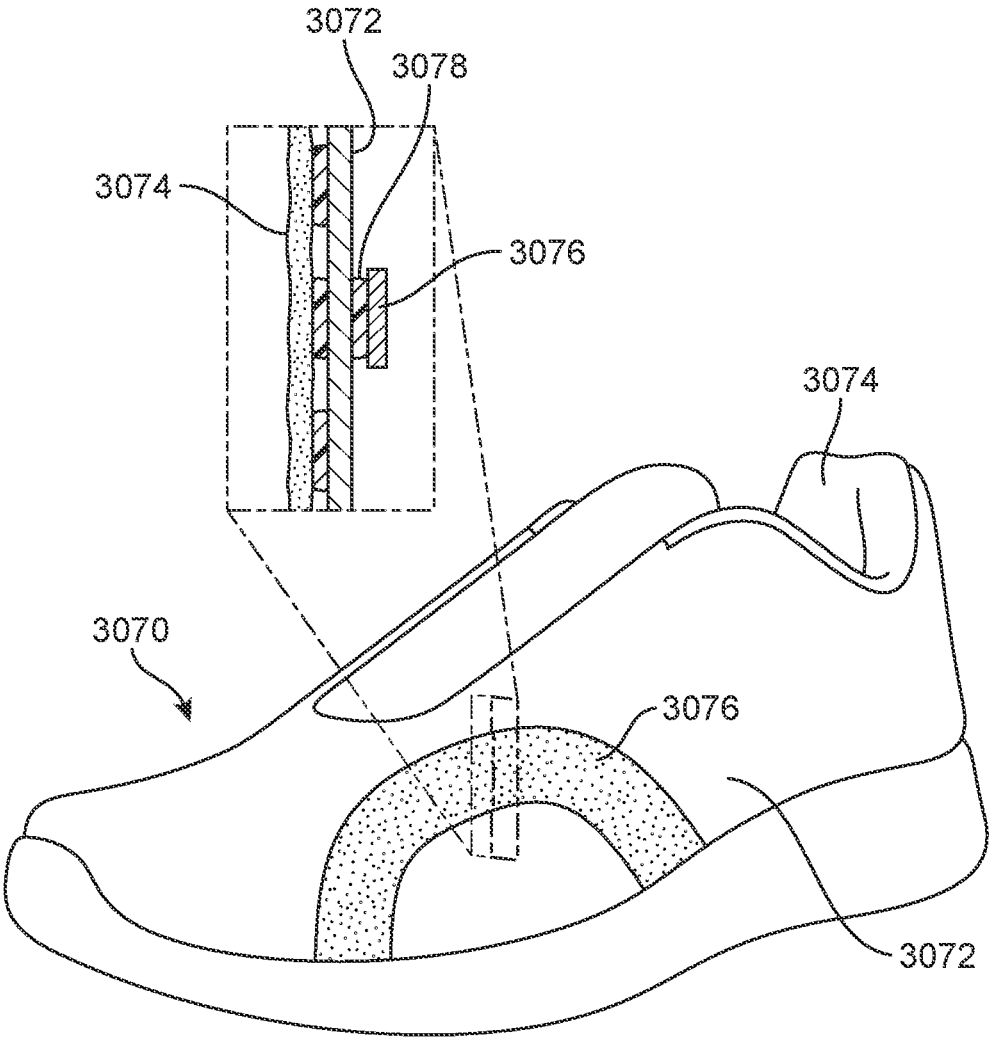
FIG. 8 is a schematic view of an article of footwear having a base layer, an inner liner, and an external trim piece all connected using hot melt sequins, according to an embodiment.

FIG. 8 illustrates a schematic view of shoe 3070 with base layer 3072, inner liner 3074, and external trim element 3076. These elements are attached by bonding regions 3078 that were formed by stitching a plurality of sequins to the inner and outer sides of base layer 3072 prior to assembly of the shoe.

Figure 9:
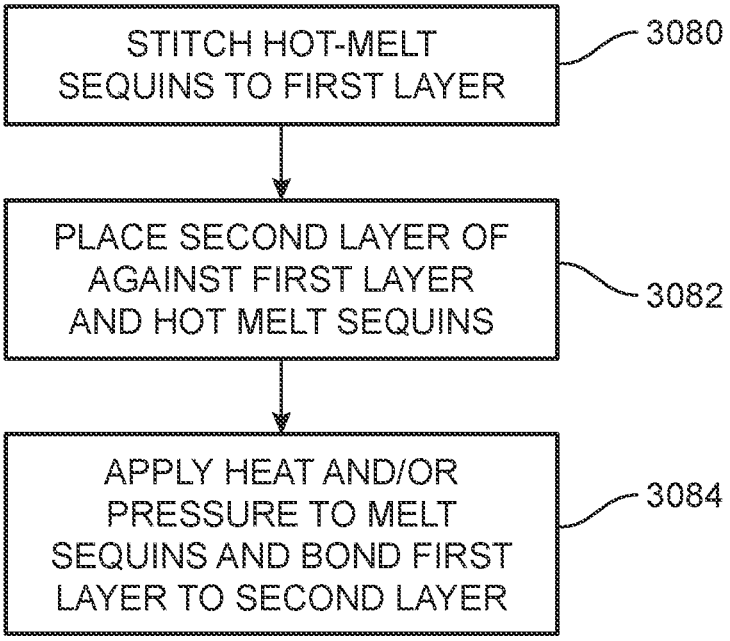
FIG. 9 is a schematic view of a process for bonding a first layer and a second layer of material to one another using hot melt sequins, according to an embodiment.

FIG. 9 is a schematic view of a process for joining two layers of material using hot melt sequins, according to an embodiment. In first step 3080, one or more sequins may be stitched to a first layer. Next, in second step 3082, a second layer may be placed against the first layer and the sequins. In third step 3084, heat and/or pressure may be applied to melt the sequins and bond the first layer with the second layer.

While this method describes bonding two "layers," it may also be suitable for bonding any two discrete elements or components when sequins can be stitched to at least one of the elements or components.

It may be appreciated that the present methods may facilitate the joining of two materials that cannot be easily welded together (e.g., using sonic or other kinds of welding). This may occur, for example, when two dissimilar materials have different melting temperatures. In such a situation, the present methods would allow for the joining of these two materials using hot melt sequins.

Embodiments can include provisions for arranging multiple sequins in "chains" or other one-dimensional arrangements on a fabric. In some embodiments, two or more sequins could be arranged in an overlapping chain on a fabric. In other embodiments, two or more sequins may be arranged adjacent to one another in a chain without any overlap between sequins. The arrangement of hot melt sequins in one or more chains allows for attaching elements (e.g., fabric layers) along one or more continuous "seams." Chains of sequins may also be used to form continuous structural elements on an article, for example, by placing a chain of sequins on an exterior surface on an article (e.g., upper of a shoe) and heating the sequins so they form a long continuous plastic structure after cooling.

Figure 10:
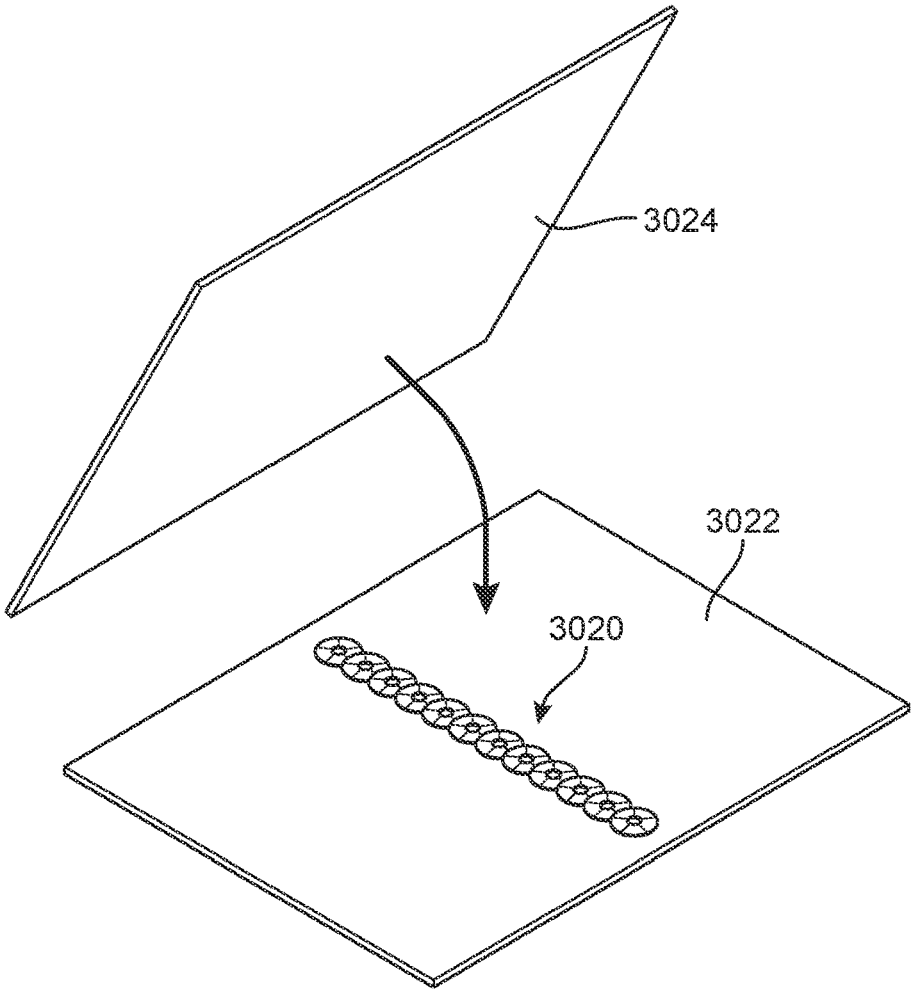
FIG. 10 is a schematic view of a process for stitching a chain of hot melt sequins to an article, according to an embodiment.
Figure 11:
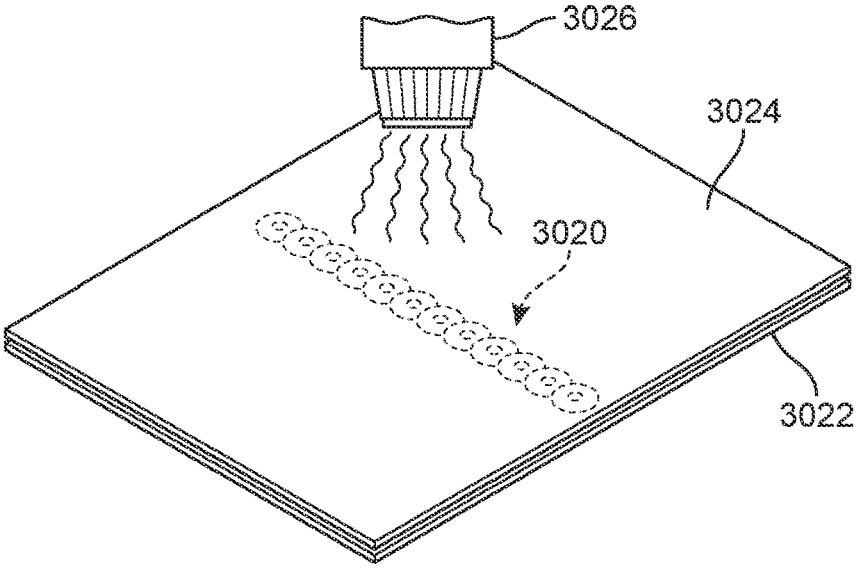
FIG. 11 is a schematic view of a step in a process for joining to textile layers using the hot melt sequins of FIG. 7, in which the chain of hot melt sequins is heated.
Figure 12:
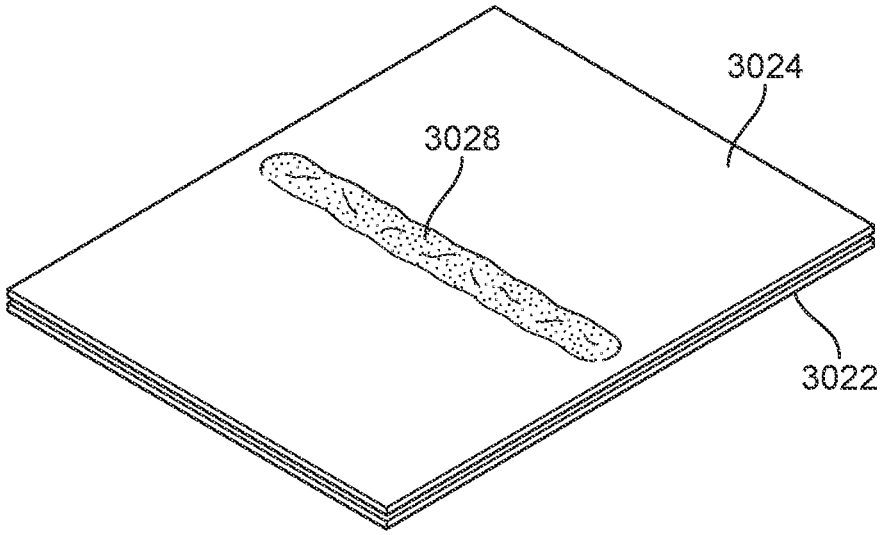
FIG. 12 is a schematic view of the textile layers of FIG. 8 being joined together.
Figure 13:
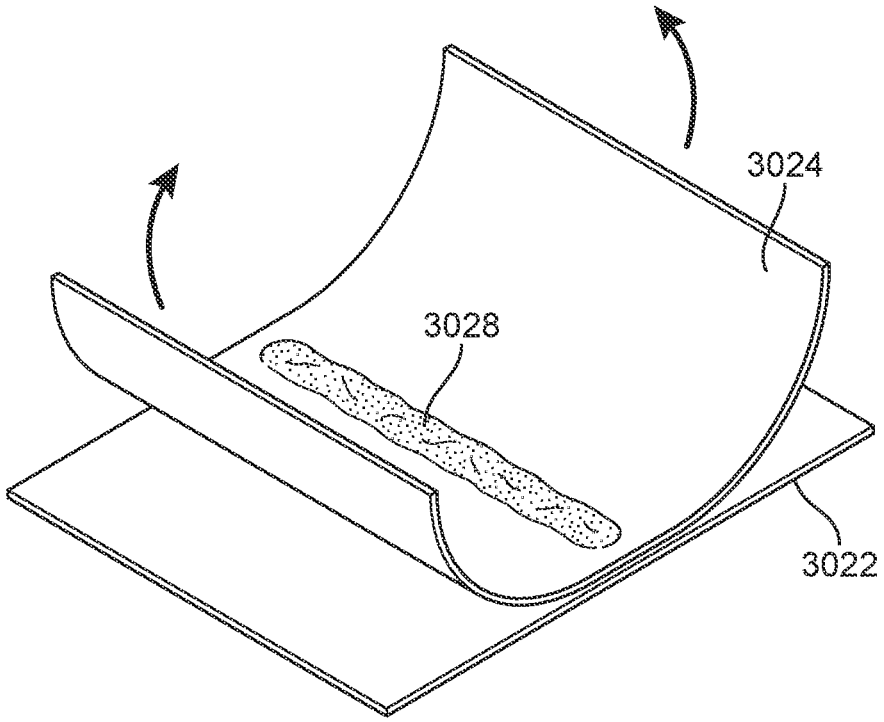
FIG. 13 is a schematic view further illustrating how the textile layers of FIG. 9 are joined along a linear seam.

FIGS. 10-13 illustrate schematic views of steps in a process for joining two fabric layers along a continuous linear seam, according to an embodiment. First, chain of sequins 3020 is arranged on first fabric layer 3022, as seen in FIG. 10. In some cases, chain of sequins 3020 may be stitched into place using any of the methods and/or systems described previously in this application. Next, second fabric layer 3024 is placed against first fabric layer 3022 and chain of sequins 3020 and heated using heating device 3026, as seen in FIG. 11. This melts chain of sequins 3020 into a one-dimensional region of adhesive material that forms a linear seam or bonded region 3028 (see FIGS. 12-13) between first fabric layer 3022 and second fabric layer 3024.

While the exemplary embodiment of FIGS. 10-13 illustrate a simple linear seam formed from a chain of sequins, it may be appreciated that other more complicated seams can be formed using these methods. For example, the present methods may be used to form multiple linear seams that cross over one another in various patterns (X-shaped, T-shaped, grid, etc.). Furthermore, in some embodiments, the chain of sequins can be curved to form seams that are curved. In other words, in other embodiments, sequins need not be arranged in straight lines, but could be arranged in any path having any shape including non-linear shapes (e.g., sinusoidal).

Embodiments can include provisions for arranging multiple sequins in two-dimensional patterns on a fabric or other substrate. In some embodiments, a plurality of sequins can be arranged in an overlapping pattern on a fabric. In other embodiments, a plurality of sequins may be arranged adjacent to one another in a two-dimensional array without any overlap between sequins. The arrangement of hot melt sequins in two-dimensional arrays allows for attaching elements (e.g., fabric layers) along continuous zones. Additionally, two-dimensional patterns of sequins may also be used to form two-dimensional structural elements on an article, for example, by placing a pattern of sequins on an exterior surface on an article (e.g., upper of a shoe) and heating the sequins so they form a two-dimensional plastic structure (e.g., a panel, counter, etc.) after cooling.

Figure 14:
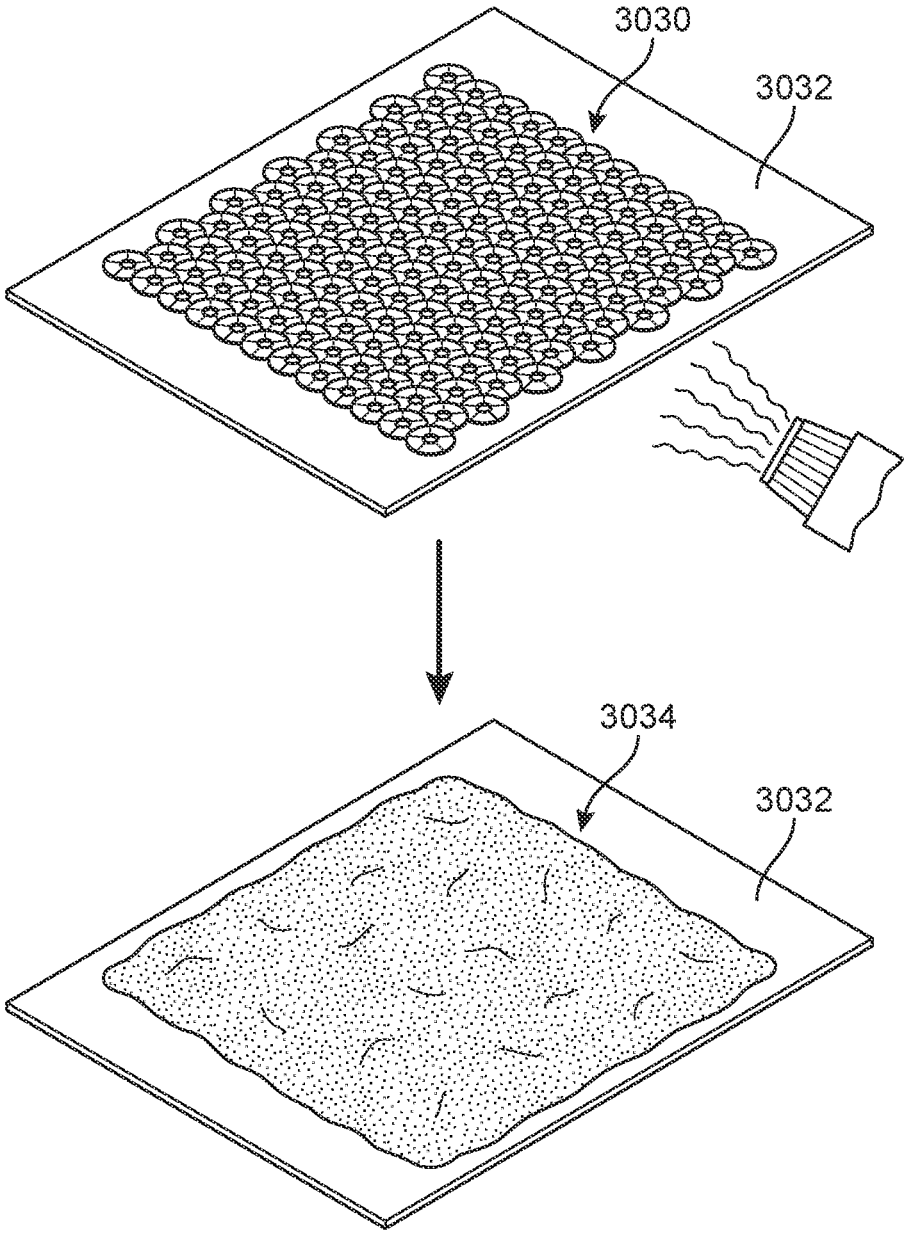
FIG. 14 is a schematic view of an embodiment of a step in a process for forming a two-dimensional bonding region on a substrate using an array of hot melt sequins.

FIG. 14 illustrates a schematic view of an embodiment using two-dimensional arrangement of sequins 3030 (or simply sequins 3030) on fabric layer 3032 to create two-dimensional attachment region 3034 following the application of heat and/or pressure. In the present embodiment, sequins 3030 are arranged in an overlapping "fish scale" pattern. However, in other embodiments, a plurality of sequins could be arranged in any two-dimensional pattern.

Embodiments can include provisions for arranging multiple sequins in three-dimensional patterns on a fabric or other substrate. In some embodiments, two or more sequins can be stacked atop one another in a vertical direction (i.e., in a direction perpendicular to the substrate). In some cases, three, four, five, six, or more sequins could be stacked in a vertical direction. These sequins can be stitched in a stacked manner using one or more of the methods for attaching sequins to a substrate described previously in this application.

Figure 15:
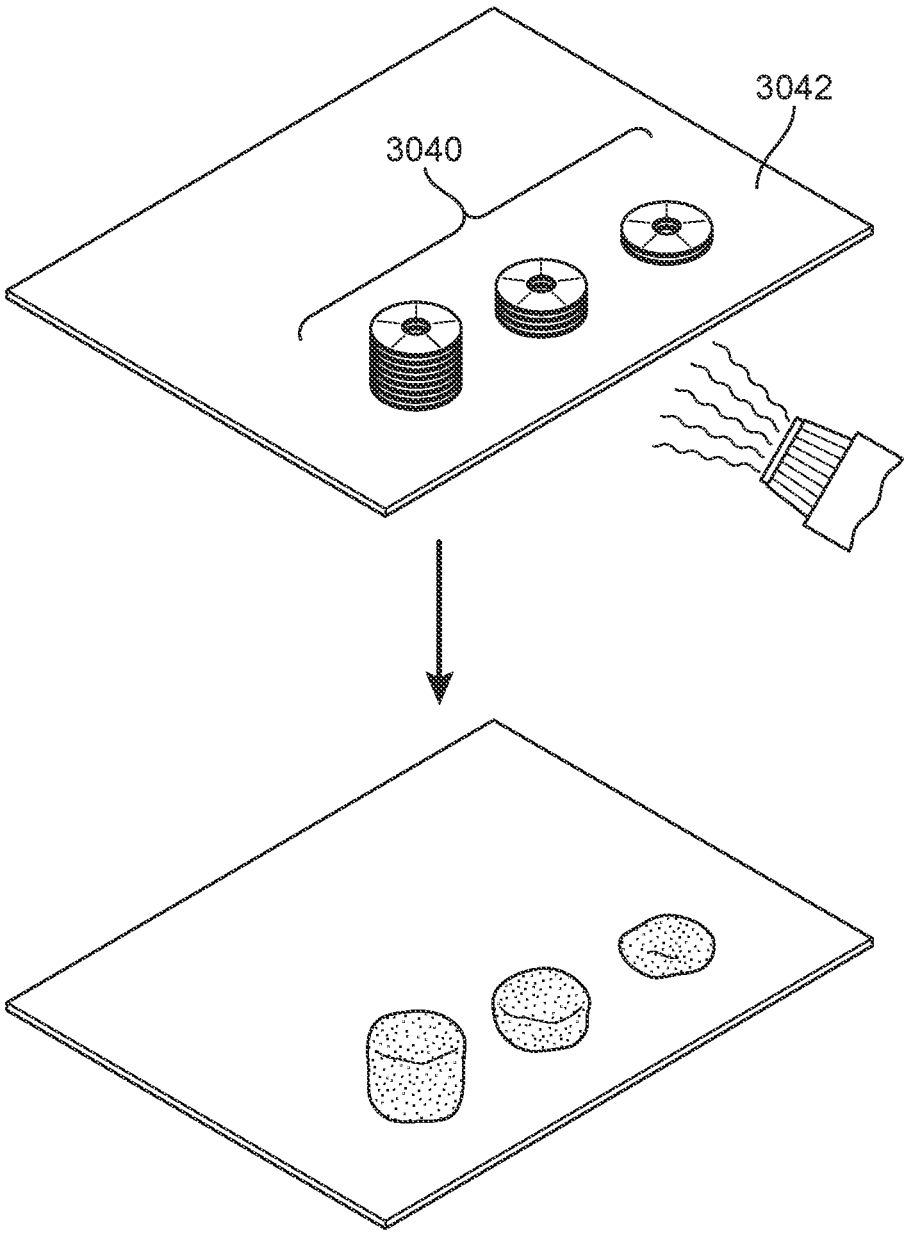
FIG. 15 is a schematic view of an embodiment of a step in a process for forming a three-dimensional hot melt structure on a substrate using stacks of hot melt sequins.

FIG. 15 is a schematic view of a pattern of stacked sequins 3040 attached to fabric layer 3042. Stacked sequins 3040 (arranged in distinct stacks of varying numbers of sequins) are then transformed into a three-dimensional arrangement of hot melt material following the application of heat and/or pressure. In some embodiments, this method can be used to form three-dimensional structures on the surface of an article. In this case, the three-dimensional structures may be formed of a material including a hot melt material that solidifies upon cooling. Alternatively, in another embodiment, this method allows for the bonding of adjacent elements with some spacing: that is, adjacent elements may be bonded to ends of the stack of hot melt sequins, but as the hot melt cools, some of the material may act to provide spacing between the bonded elements.

In some embodiments, sequins can be arranged in patterns that comprise combinations of the arrangements described above. For example, sequin configurations could be comprised of linear or 1D chains intersecting with 2D arrangements. Likewise, 1D and/or 2D arrangements of sequins could intersect with 3D stacks of sequins. Thus, by utilizing various combinations of 1D, 2D, and 3D arrangements for sequins, various complex seams or bonds between layers or other structures can be formed. Likewise, by utilizing combinations of 1D, 2D, and 3D arrangements for sequins, various complex structures can be formed on the surface of one or more components in an article.

It may be appreciated that some embodiments can include provisions for stitching different kinds of sequins to an article. Using two or more separate sequin feeds with an embroidery machine may allow for creating structures comprised of different kinds of sequins. Specifically, chains, arrays and/or three-dimensional stacks of sequins could be created with different kinds of sequins having different properties (e.g., different colors, different strengths, etc.).

Figure 16:
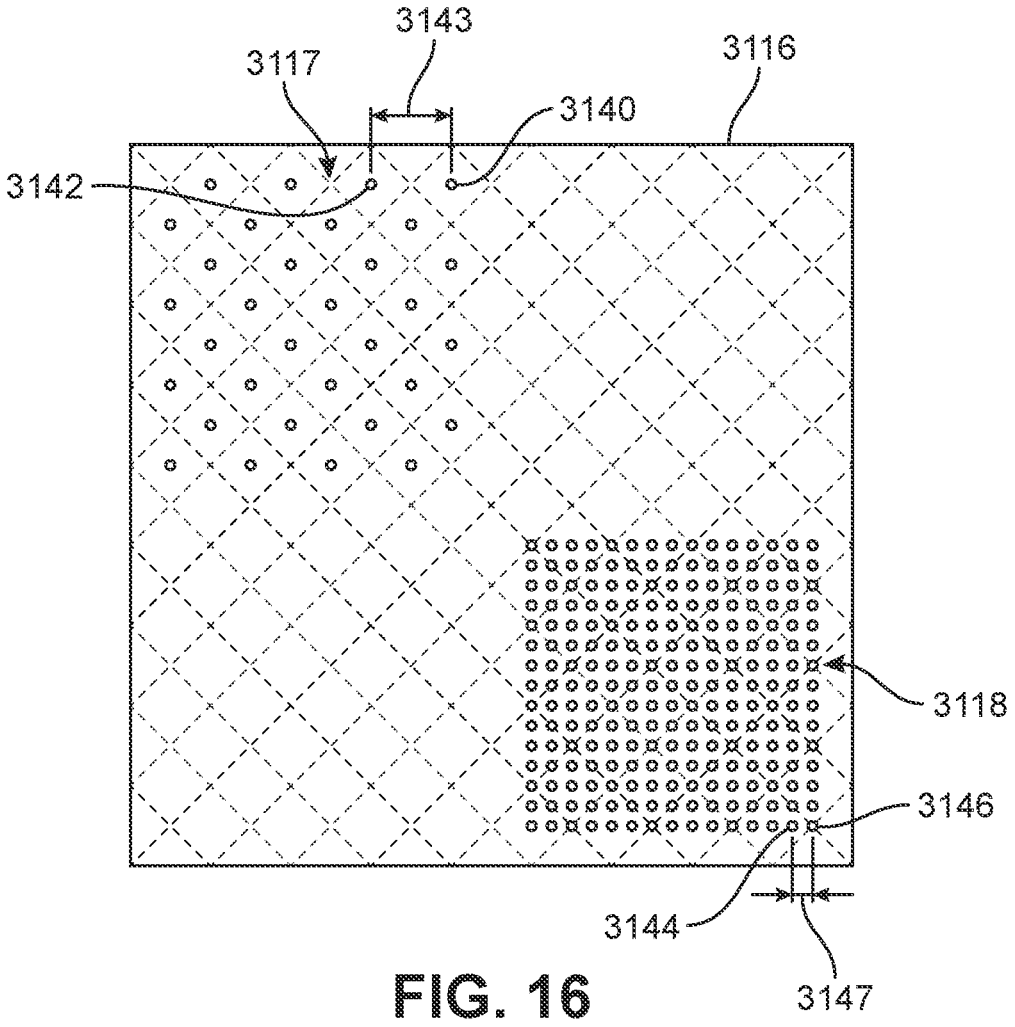
FIG. 16 is a schematic view of a layer of textile material including two distinct patterns of sequins having different densities, according to an embodiment.

In different embodiments, the density or relative spacing between adjacent sequins could vary. FIG. 16 is a schematic view of textile layer 3116 with two distinct patterns of sequins (shown schematically as dots in FIG. 20). In this embodiment, first pattern 3117 is more widely spaced (i.e., less dense) than second pattern 3118. Specifically, first sequin 3140 and second sequin 3142 within first pattern 3117 are separated by first distance 3143. Likewise, third sequin 3144 and fourth sequin 3146 within second pattern 3118 are separated by second distance 3147 that is less than first distance 3143.

Varying the density of hot melt sequins may facilitate complicated bonding patterns between two layers (or components), for example. Specifically, the density and/or pattern of sequins can be customized (by simply adjusting the embroidery pattern prior to stitching) to create complicated seams and pockets between two layers. This allows for some regions of a two-layer component to be "locked down," while in other regions the two layers can move more independently. These more complicated seams and pockets can be used to modify the flexibility, modify thermal properties (by creating air pockets for insulation), adjust the fit, as well as modify other properties of a two-layer component. Furthermore, these provisions can be incorporated into layers in articles of footwear (e.g., the upper), layers of apparel, layers in accessories and/or layers in equipment (e.g., sporting equipment like baseball mitts, padding, etc.). Moreover, various kinds of bonding patterns can be further facilitated by varying not only the density of sequins but also their arrangements in 1D, 2D, and/or 3D as described above.

Figure 17:
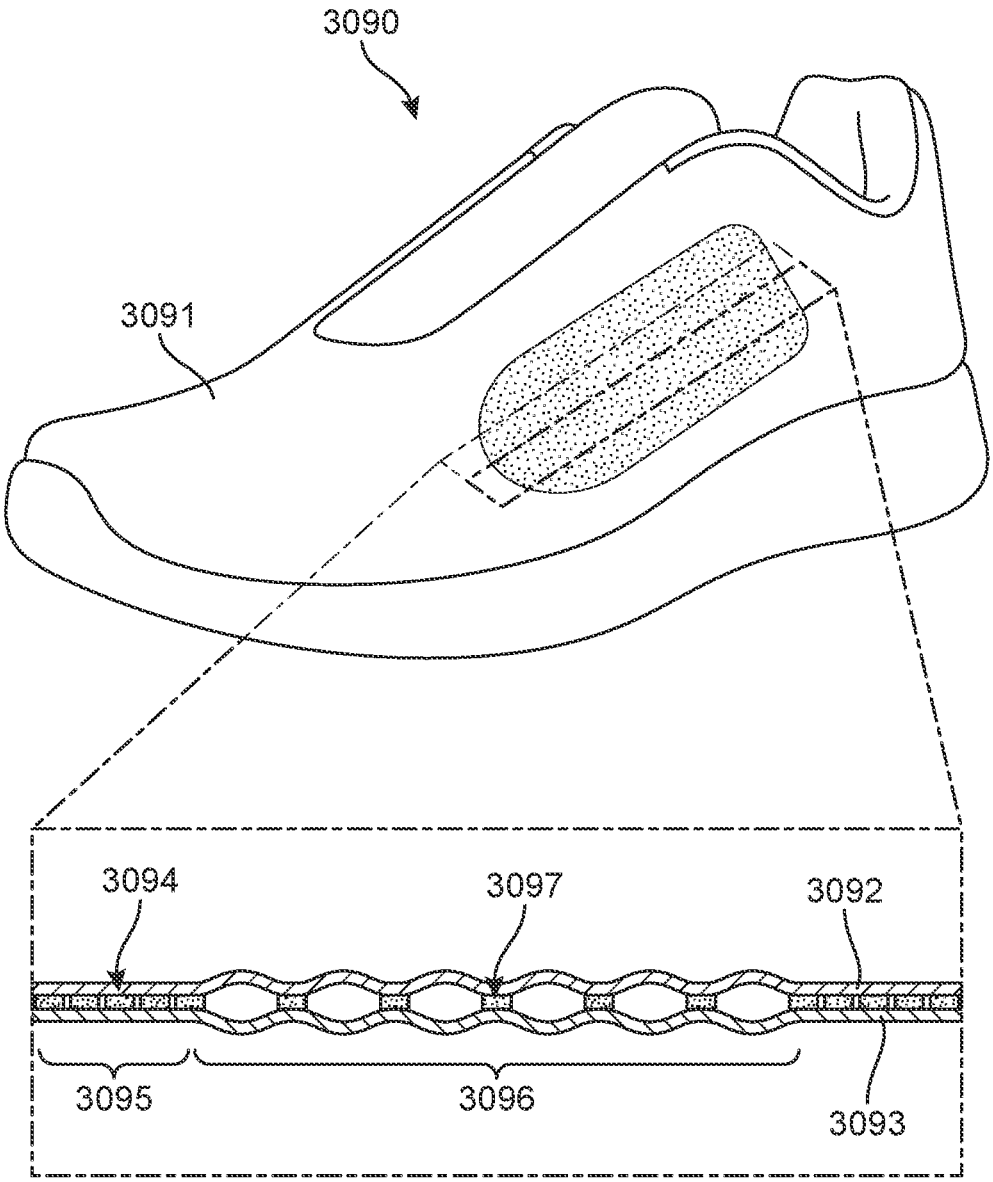
FIG. 17 is a schematic view of an article of footwear with an enlarged cross-sectional view, according to an embodiment.

FIG. 17 illustrates a schematic view of article 3090 with upper 3091. Upper 3091 is comprised of outer layer 3092 and inner layer 3093, as seen in the enlarged cross-sectional view in FIG. 17. Moreover, throughout much of upper 3091, outer layer 3092 and inner layer 3093 are tightly bonded via densely spaced hot melt sequins 3094, including at first region 3095. However, in second region 3096, outer layer 3092 and inner layer 3093 are more loosely coupled due to a less dense arrangement of hot melt sequins 3097. This may allow for more independent movement between outer layer 3092 and inner layer 3093 in second region 3096 as compared to first region 3095, which may be useful for varying the flexibility, thermal properties, and/or fit between these two regions. It may be appreciated that the embodiment of FIG. 17 is only exemplary and other embodiments could include any other bonding patterns between an outer and inner layer to create regions that vary in their degree of connectedness (and thus, relative mobility, flexibility, etc.).

Figure 33:
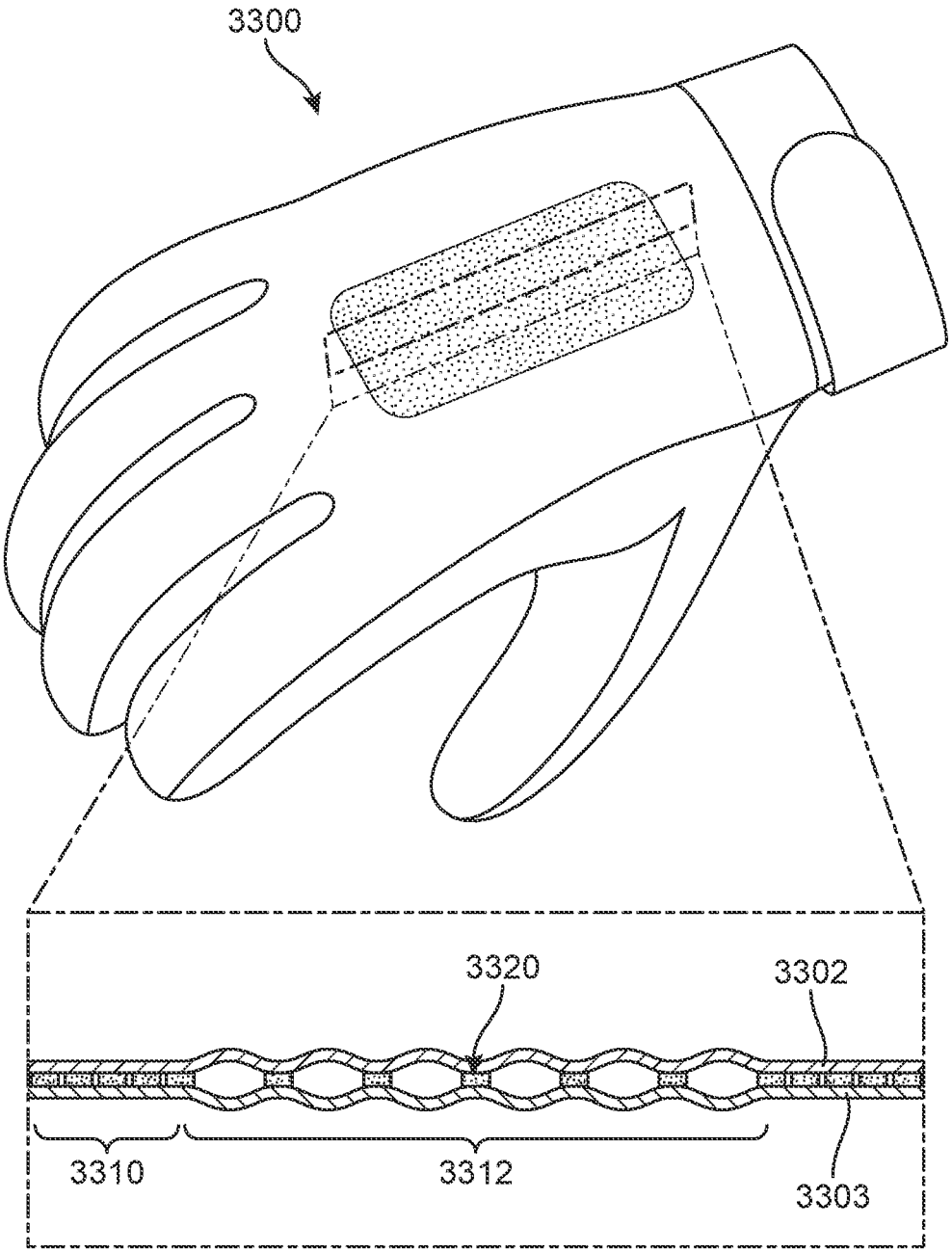
FIG. 33 is a schematic view of an embodiment of an article of apparel with multiple layers joined by sequins.

It may be appreciated that other kinds of articles (e.g., gloves, socks, shirts, jackets, pants as well as other kinds of apparel) can be configured with layers bonded by hot melt sequins. FIG. 33 illustrates a schematic view of an article of apparel 3300 (a glove in this embodiment) that may have a similar construction to upper 3090 of FIG. 17. Specifically, article 3300 is comprised of outer layer 3302 and inner layer 3303. These layers are bonded in a first region 3310 and a second region 3312. In first region 3310, sequins 3320 are more densely spaced than in second region 3112. This allows for variations in flexibility, thermal properties and/or fit between these two regions.

Figure 18:
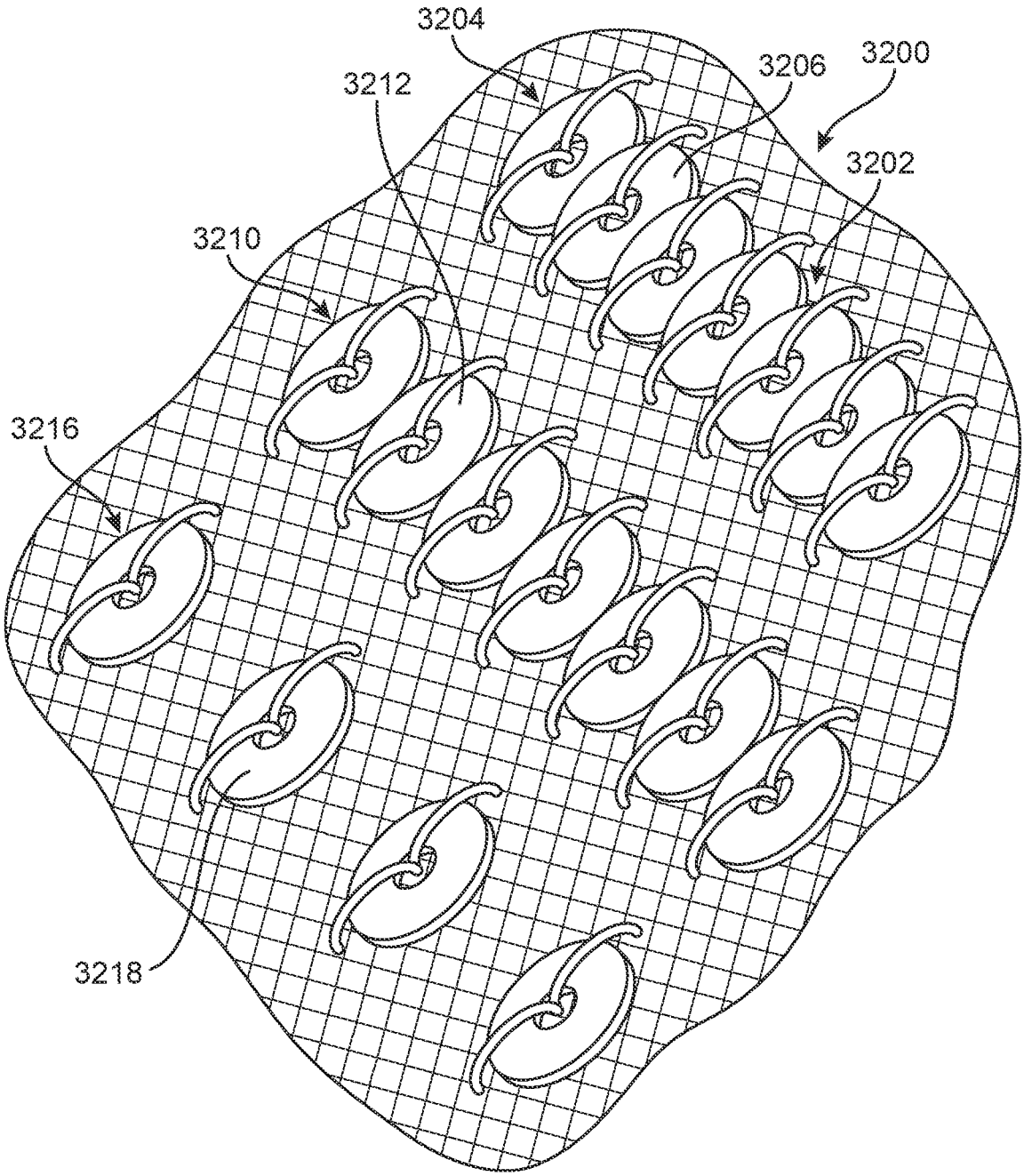
FIG. 18 is a schematic view of a region of an article with a plurality of sequins arranged in different patterns according to an embodiment.

In different embodiments, not only can the spacing between adjacent sequins be varied, but the type of contact may also vary. For example, FIG. 18 is a schematic view of an enlarged region of article 3200 to which plurality of sequins 3202 have been stitched and bonded. For purposes of illustration, these sequins have been arranged into three distinct rows. In first row 3204, set of sequins 3206 is arranged in an overlapping manner such that the side of one sequin facing the substrate of article 3200 is disposed on the side of an adjacent sequin that is facing outwardly (away from the substrate). Such an overlapping configuration has been discussed above and shown in FIGS. 10 and 14. In second row 3210, set of sequins 3212 is arranged such that adjacent sequins are in contact along their edges or spaced slightly apart. As used herein, "slightly apart" refers to a distance significantly less than a diameter of either of the adjacent sequins. In third row 3216, set of sequins 3218 is arranged such that adjacent sequins are spaced apart by a distance substantially similar to, or greater than, a diameter of either of the adjacent sequins. It may be appreciated that the type of contact: overlapping, immediately adjacent or spaced, can be varied to achieve desired properties for a resulting article.

Embodiments can include provisions for arranging sequins in patterns that vary in density or dispersion. In some embodiments, spacing between adjacent sequins can be constant. In other embodiments, the spacing can be variable. In some embodiments, the spacing may vary along one or more dimensions of an article. As an example, some articles can include an arrangement of sequins that is denser in some locations and gradually decreases in density in one or more directions. It may be appreciated that the methods described herein for applying sequins to a substrate allow for variable dispersion patterns (i.e., gradient patterns) to be applied simply by changing the embroidery pattern of the sequins. This may allow for regions that vary more gradually in one or more properties (e.g., abrasion resistance, flexibility, etc.).

Figure 19:
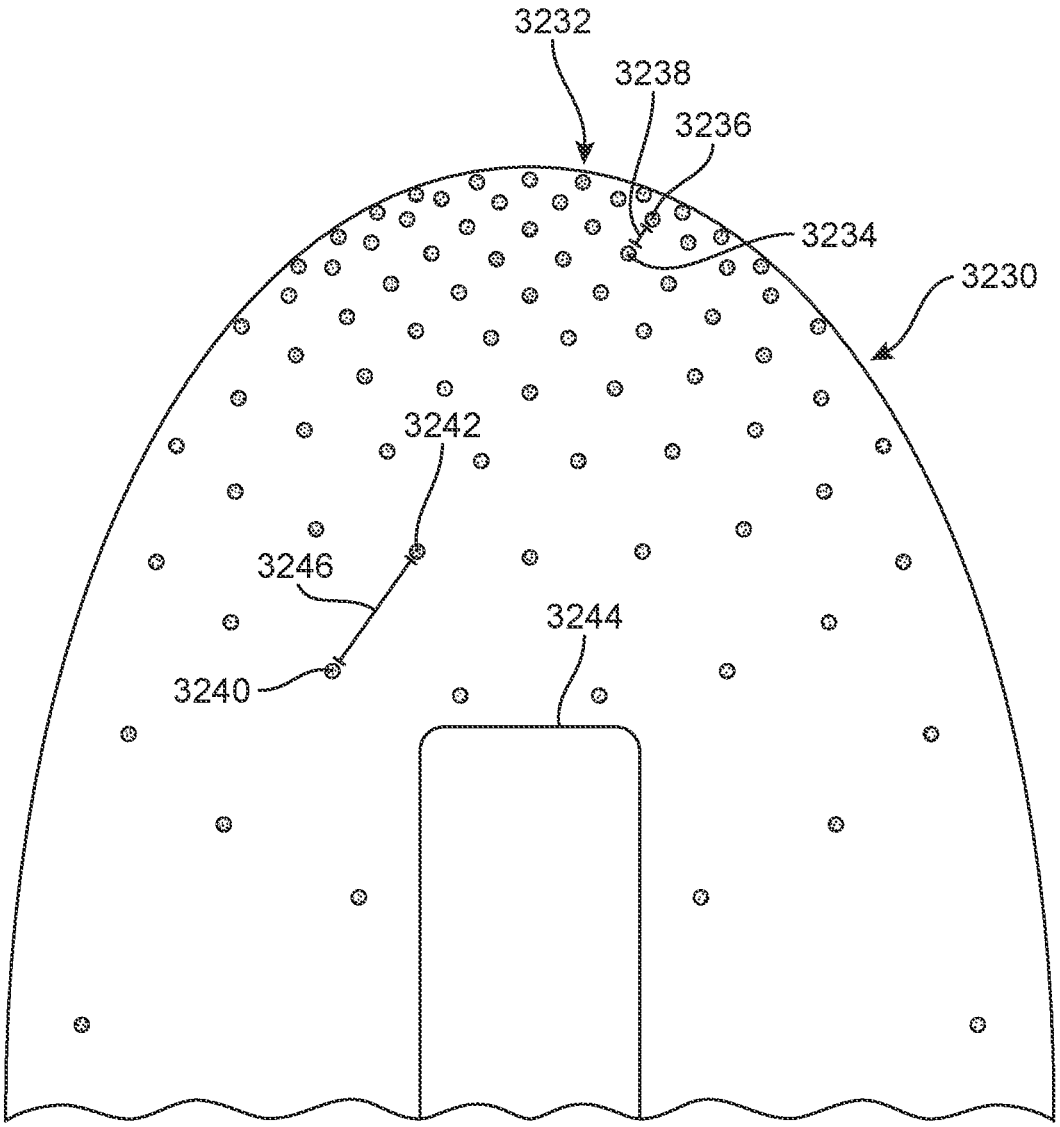
FIG. 19 is a schematic view of an upper pattern with a plurality of sequins arranged in a variable density pattern, according to an embodiment.

One example of a variable dispersion pattern is shown in FIG. 19. In this example, a plurality of sequins has been stitched and heat bonded to upper pattern 3230 prior to assembling upper pattern 3230 with other components to form an article of footwear. As clearly seen in FIG. 19, the density of sequins generally increases in directions away from central toe portion 3232. For example, first sequin 3234 and second sequin 3236, disposed in central toe portion 3232, are spaced apart by distance 3238. In contrast, third sequin 3240 and fourth sequin 3242, disposed adjacent lacing region cutout area 3244 of upper pattern 3230, are spaced apart by distance 3246. In this case, distance 3246 is greater than distance 3238. Moreover, in some embodiments, the distance between adjacent sequins may vary gradually in one or more directions.

Figure 20:
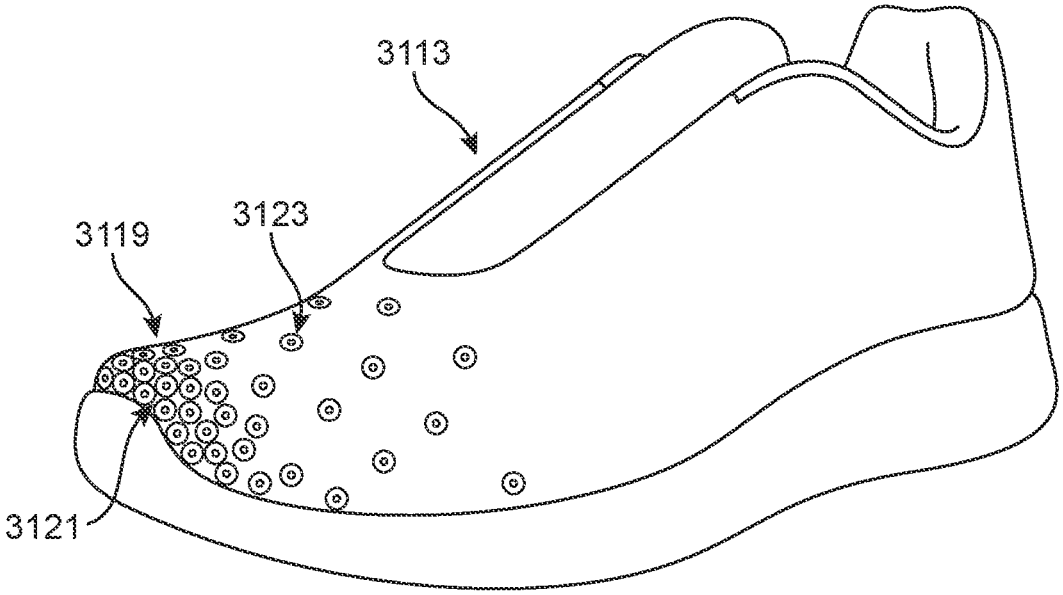
FIG. 20 is an article of footwear including a plurality of sequins arranged in a dispersive pattern, according to an embodiment.
Figure 21:
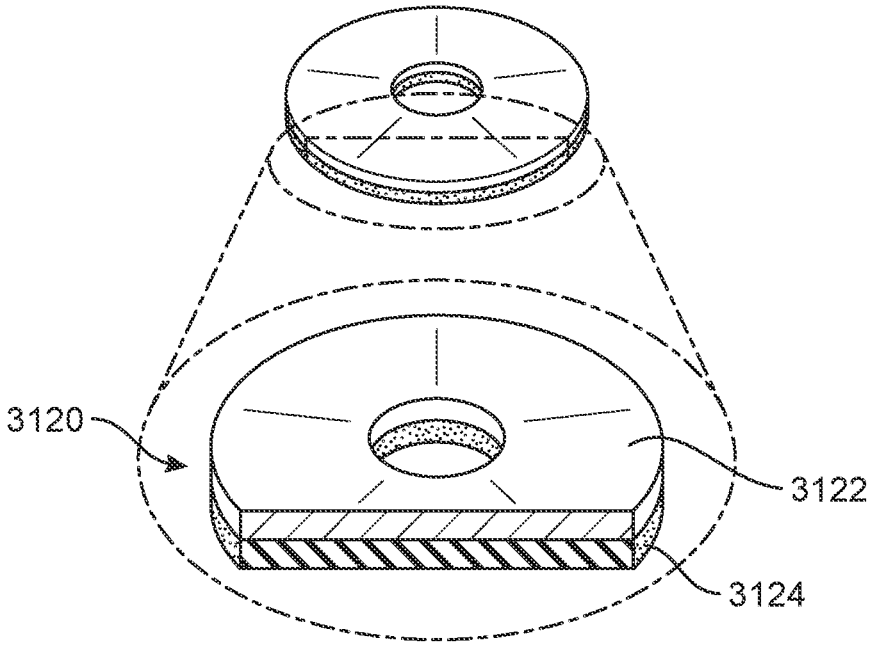
FIG. 21 is an embodiment of a dual-layer sequin.

Another example is shown in FIG. 20, which is a schematic view of an embodiment of article of footwear 3113 that includes dispersive pattern of sequins 3119. In this case, the pattern of sequins has a density that is highest in the toe region and gradually decreases in the lateral and longitudinal directions away from the toe region. More specifically, first group 3121 of sequins in the toe region of article of footwear 3113 is arranged in a higher density configuration than second group 3123 of sequins outside (rearwardly of) the toe region.

It may be appreciated that hot melt sequins can be applied to textile layers and/or other components for purposes beyond bonding. For example, in situations where a TPU layer may be applied to some layer (e.g., the exterior of an upper in an article of footwear), the present methods can be used to apply TPU sequins to the layer, rather than using a TPU film. Because the sequins can be stitched to the surface in different densities, including spaced apart or overlapped patterns, this allows the TPU to be applied in a discrete pattern or, using overlapping sequins and melting them together, as a continuous layer or coating. Thus, TPU sequins can be applied in any patterns (and optionally melted) so as to modify the flexibility, abrasion resistance, strength, etc. of a layer in an article of footwear, article of clothing, accessory and/or equipment.

In some embodiments, sequins could be made of two or more distinct material regions. In some embodiments, a sequin could have a first material region on a first side and a second material region on a second side. The first material region could comprise material including a hot melt (e.g., TPU) that may act to bond the sequin to an underlying substrate after the sequin has been stitched in place and then heated to activate the bonding process. The second material region on the second side of the sequin could be configured with material and/or structural properties to achieve various desired properties for an exterior region of an article. These properties could include abrasion resistance, water resistance, as well as other properties.

FIGS. 21-24 illustrate schematic views of steps in a process for securing a two-layered sequin to a substrate layer, according to an embodiment. Here, sequin 3120 is seen to comprise first portion 3122 (or first layer) comprised of a first material and second portion 3124 (or second layer) comprised of a second material. In some embodiments, second portion 3124 is comprised of a material including a hot melt material.

In one embodiment, first portion 3122 may include polyurethane (PU), or reactive polyurethane, while second portion 3124 may include thermoplastic polyurethane (TPU). In some cases, the PU layer may have a cross-linked molecular structure that has improved abrasion-resistant properties over TPU. In such an arrangement, the TPU portion of the sequin acts as an adhesive to bond the more abrasion-resistant PU layer to a substrate.

In some embodiments, a dual layer sequin could be manufactured by punching sequins from co-extruded films. For example, in some embodiments, a PU film may be co-extruded with a TPU film, and the resulting composite can be "punched" or otherwise cut to create dual-layer sequins. A similar method of making dual-layer sequins could be achieved with other co-extruded films of differing materials.

Figure 22:
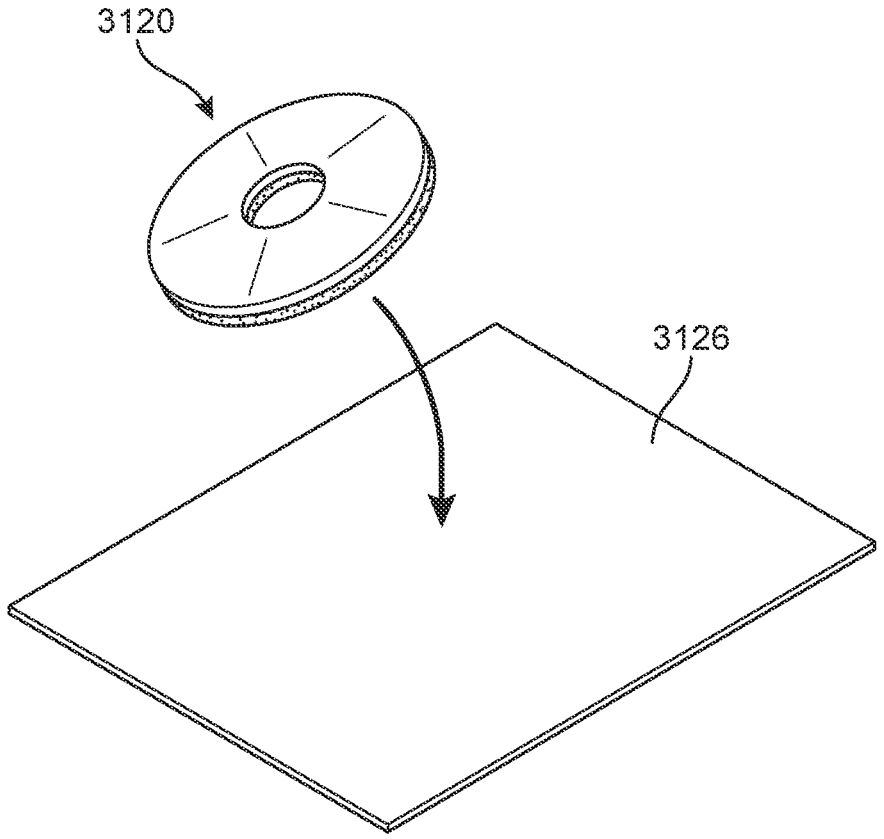
FIG. 22 is a schematic view of an embodiment of a dual-layer sequin and a substrate layer.
Figure 23:
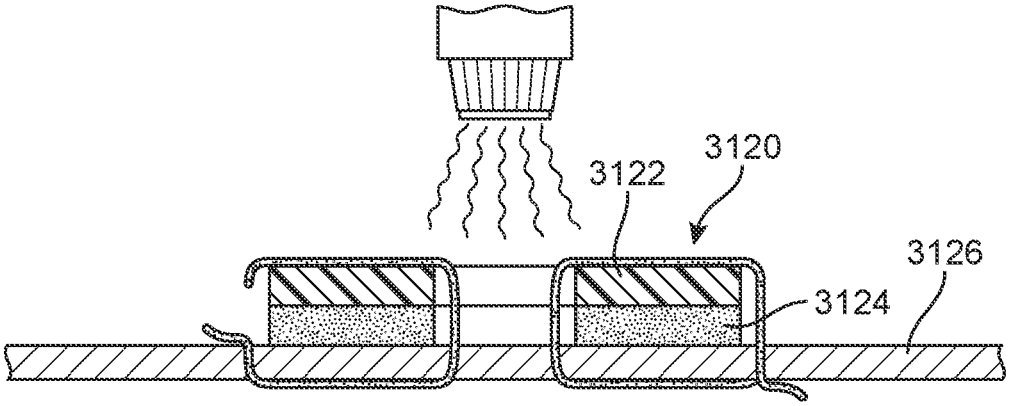
FIG. 23 is a schematic view of the dual-layer of sequin of FIG. 23 being heated.
Figure 24:
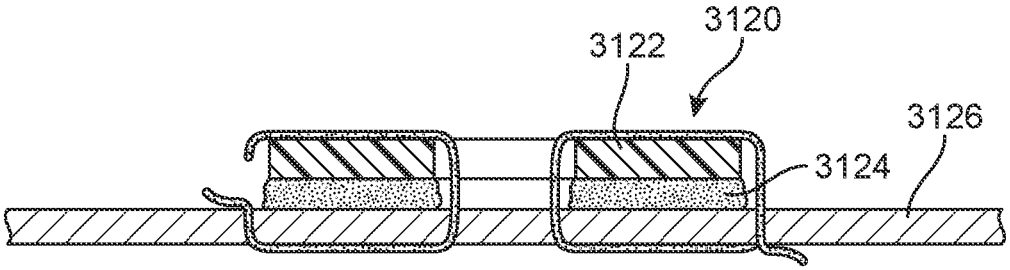
FIG. 24 is a schematic view of the dual-layer sequin of FIG. 23 bonded to the substrate layer.

FIGS. 22-24 illustrate schematic steps in applying sequin 3120 to a substrate. In a first step, sequin 3120 may be associated with (and stitched to) substrate layer 3126. Stitching sequin 3120 may be achieved using any of the methods for stitching sequins disclosed elsewhere in this application, including any of the methods and/or components disclosed in the cited applications.

Next, heat (and optionally, pressure) may be applied to substrate layer 3126 to activate the hot melt material in second portion 3124. Thus, the hot melt in second portion 3124 helps to further secure sequin 3120 (including first portion 3122) to substrate layer 3126.

In another embodiment, two separate sequins of differing materials could be stacked upon one another (as discussed previously) and stitched to a substrate. If the sequin directly adjacent to the substrate includes a hot melt material, this may result in one sequin acting to bond the second sequin to the substrate layer.

Figure 25:
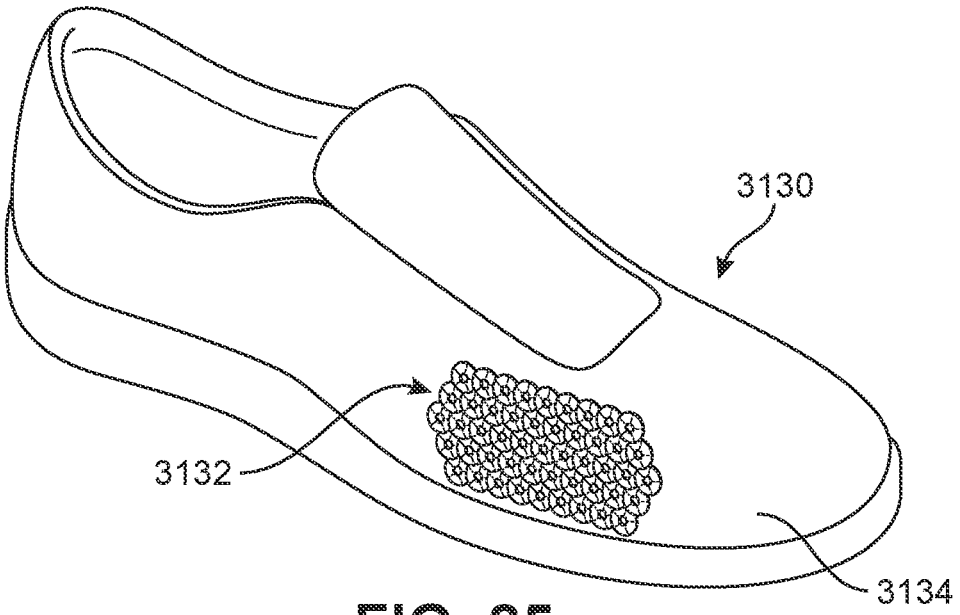
FIG. 25 is a schematic view of an embodiment of an article of footwear including a region with an array of sequins.

In some embodiments, sequins can be used to provide abrasion resistance. For example, FIG. 25 illustrates a schematic view of article of footwear 3130 with abrasion resistance region 3132. Here, abrasion resistance region 3132 may include sequins with an abrasion-resistant material secured to an exterior layer of upper 3134. In some cases, sequins with abrasion-resistant material could simply be stitched to upper 3134. In other cases, sequins with an abrasion-resistant portion and a hot melt portion could first be stitched (or otherwise temporarily secured) to upper 3134, and then treated (e.g., heated) so that the hot melt portion can bond the abrasion-resistant portion to upper 3134. In FIG. 25, the sequins comprising abrasion resistance region 3132 are shown in a non-melted state. However, in some embodiments, the sequins could be melted to create an abrasion resistant region.

Such provisions may be useful in articles of footwear and/or articles of clothing. For example, in articles of footwear, abrasion-resistant sequins may be attached to a skateboard shoe in regions that are typically associated with an abrasion-resistant patch, panel, or other layer.

Abrasion-resistant regions can also be formed with dispersive patterns of sequins, including, for example, the dispersive pattern of sequins shown in FIGS. 19-20. In some other embodiments, sequins could be applied throughout the entirety of an article (e.g., the entirety of an upper in an article of footwear) to increase abrasion resistance throughout the entire article.

In some embodiments, hot melt sequins may be applied to one or more regions of an article for the purposes of forming one or more structural components. Examples of structural components in articles include, but are not limited to, heel counters in footwear, toe caps in footwear, lace cages (or eye stays) in footwear, as well as other structural elements. Structural elements may also be formed on various kinds of articles of clothing using sequins, including any of the articles discussed previously in the present application.

Figure 26:
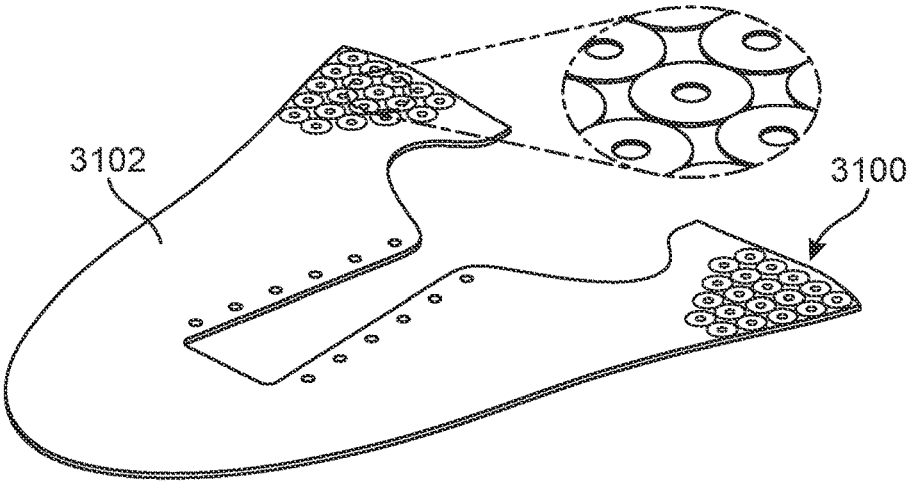
FIG. 26 is a schematic view of an upper for an article of footwear with sequins stitched in the heel region, according to an embodiment.
Figure 27:
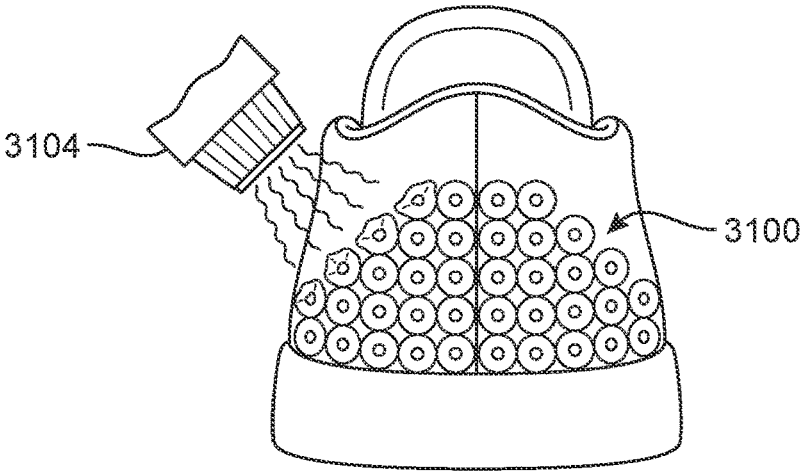
FIG. 27 is a schematic view of a step of melting sequins on the upper of FIG. 26.
Figure 28:
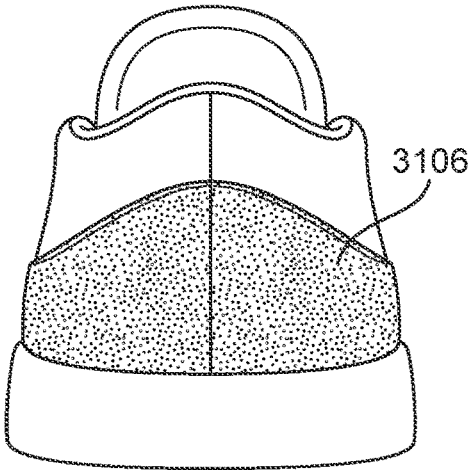
FIG. 28 is a schematic view of a heel counter formed on the article of FIG. 26.

FIGS. 26-28 illustrate schematic views of steps in a process for forming a heel counter on an article of footwear using hot melt sequins. In FIG. 26, plurality of sequins 3100 may be stitched to upper base layer 3102 using any of the methods previously described. These methods may include laying sequins down in chains, 2D arrays, 3D stacks, and/or dispersed in any other complex patterns.

Following this, upper base layer 3102 may be applied to a last or otherwise arranged into a three-dimensional shape. Next, heat may be applied to plurality of sequins 3100 using heating device 3104, as shown in FIG. 27. As the sequins are heated, the sequins may melt and form continuous heel counter 3106, as shown in FIG. 28.

Figure 29:
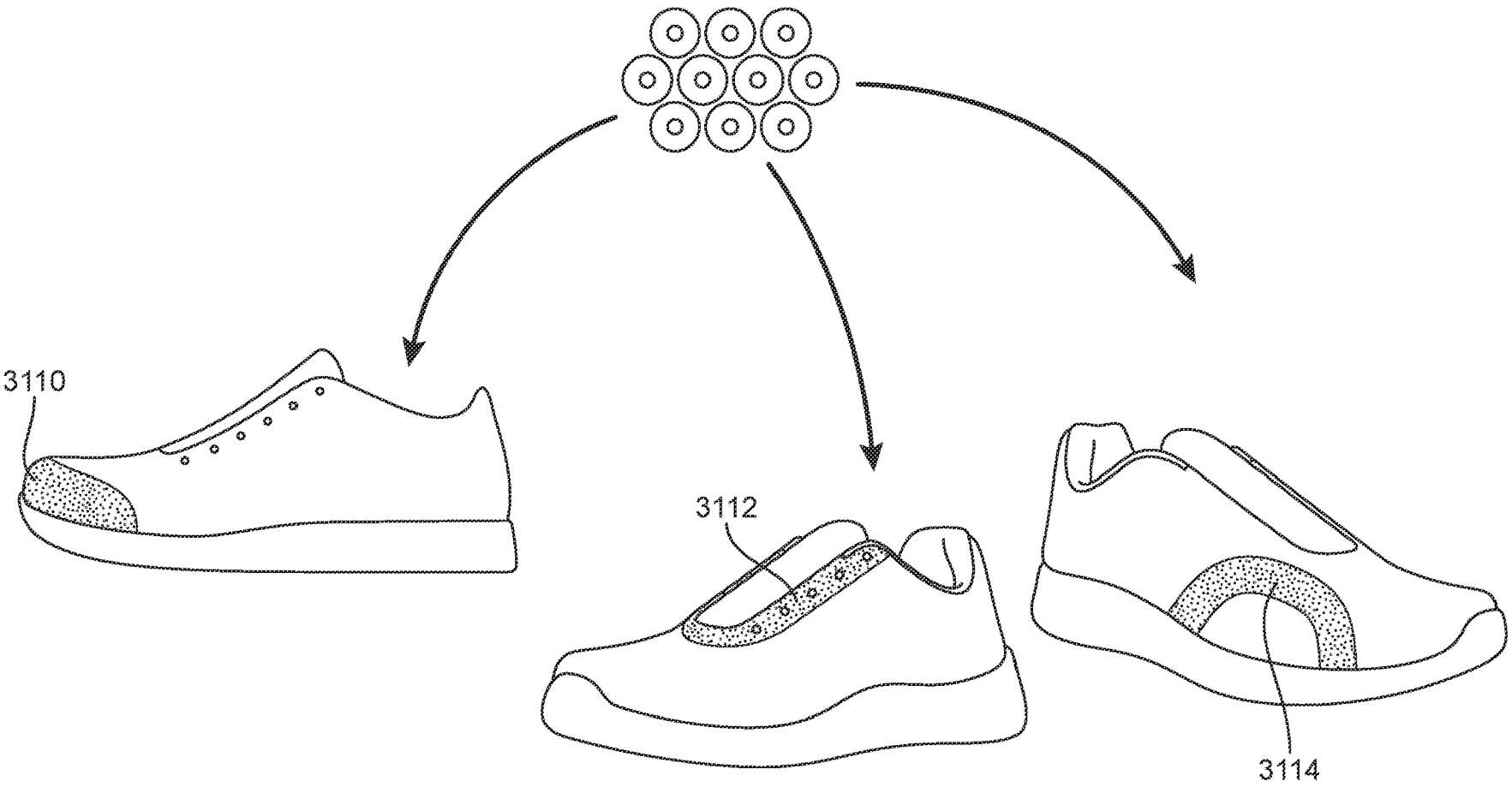
FIG. 29 is a schematic view of several articles with various regions where sequins may be applied to create functional elements, according to an embodiment.

FIG. 29 illustrates several other regions on an article where sequins may be used to form structural elements, according to an embodiment. Specifically, sequins may be applied along toe box 3110 to form a toe cap, along lacing region 3112 to form a lace cage and/or in predetermined trim region 3114 so as to form part or all of a piece of trim for an article.

In order to form various kinds of articles, a substrate may be shaped using, for example, a last. In at least some embodiments, a substrate with stitched sequins (e.g., hot melt sequins) can be shaped on a last prior to the step of heating the sequins. This allows the sequins to be melted and shaped into a three-dimensional continuous component rather than being melted and formed into a flattened component that is then flexed and shaped. Alternatively, in other embodiments, hot melt sequins could be melted on a flat part and shaped after a structural element has been formed.

Figure 30:
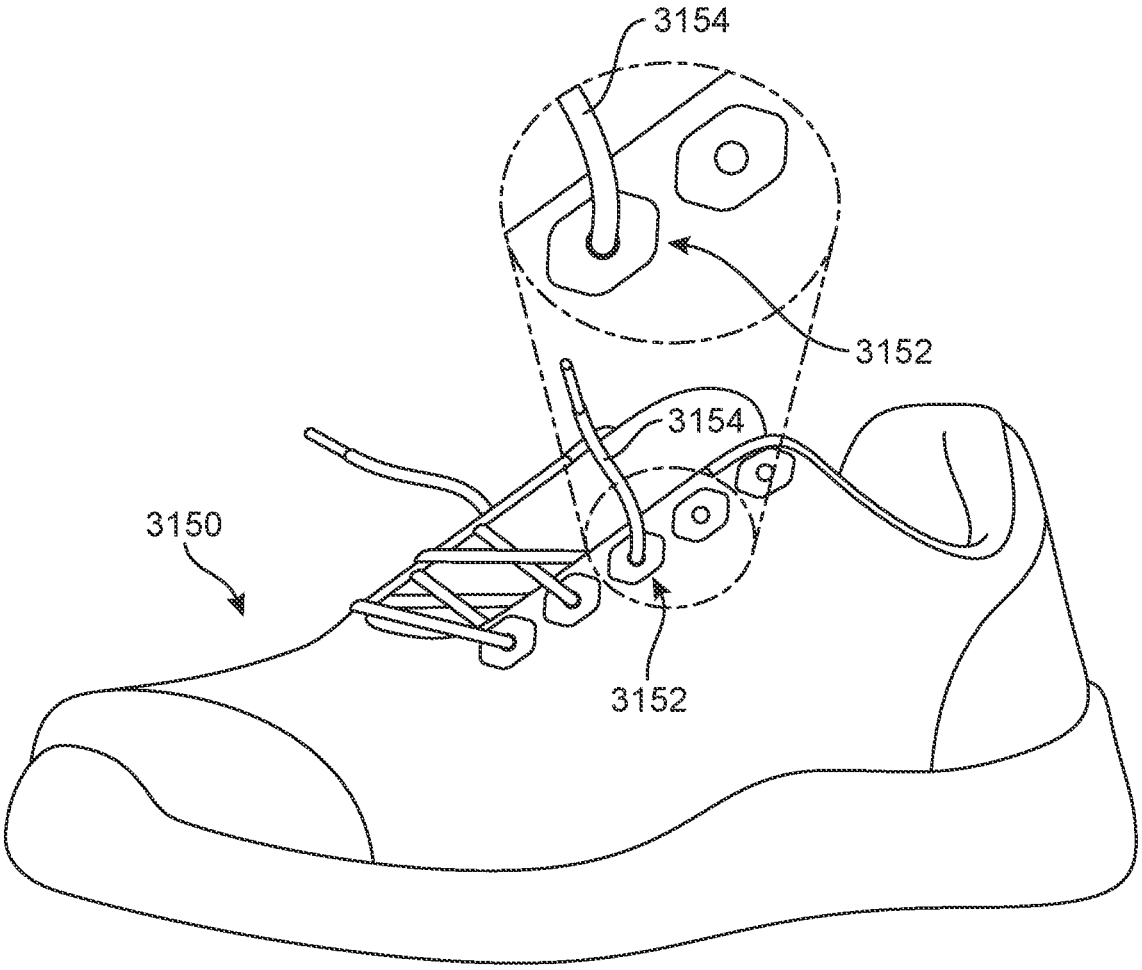
FIG. 30 is a schematic view of a plurality of sequins configured as eyelets on an article of footwear, according to an embodiment.
Figure 31:
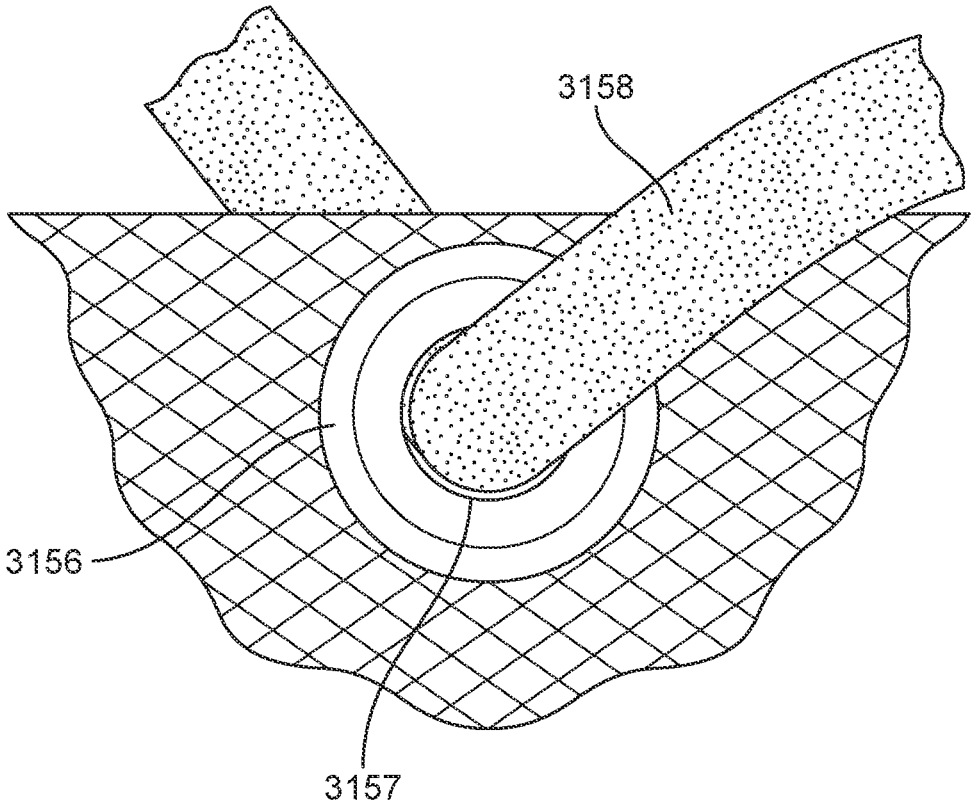
FIG. 31 is a schematic enlarged view of an embodiment of a sequin configured as an eyelet.

Embodiments can use sequins as eyelets. In some embodiments, sequins with a sufficiently large central hole may act as an eyelet that is secured in place using stitching (and/or hot melt). As seen in FIG. 30, article of footwear 3150 includes plurality of sequins 3152 that function as eyelets and reinforce openings in the upper where lace 3154 is passed through. Another example, shown in FIG. 31, shows a schematic enlarged view of a region of an article with a sequin eyelet. As seen in FIG. 31, sequin 3156 has a sufficiently large central opening 3157 to receive lace 3158.

In some embodiments, to receive a lace, sequins can be configured with a relatively large opening. In some embodiments, a sequin-based eyelet could have a total diameter in a range between approximately 3 mm and 10 mm. In some embodiments, a sequin-based eyelet could have a diameter of approximately 5.5 mm. In some embodiments, an opening in a sequin for receiving a lace can have a size in a range between 2 mm to 6 mm. In one embodiment, an opening in a sequin may have a size of approximately 3.5 mm.

In some embodiments, sequins to be used as eyelets could be dual layered including a layer of hot melt material as well as a more rigid material that helps retain a lace.

The embodiments may also include provisions for attaching lace guides or similar provisions to an article. In some embodiments, one or more lace guides (e.g., tubes) could be secured to an article using hot melt sequins.

Sequin-based eyelets may also be used on articles of apparel. For example, hoodies that use drawstrings can incorporate sequin-based eyelets.

Figure 32:
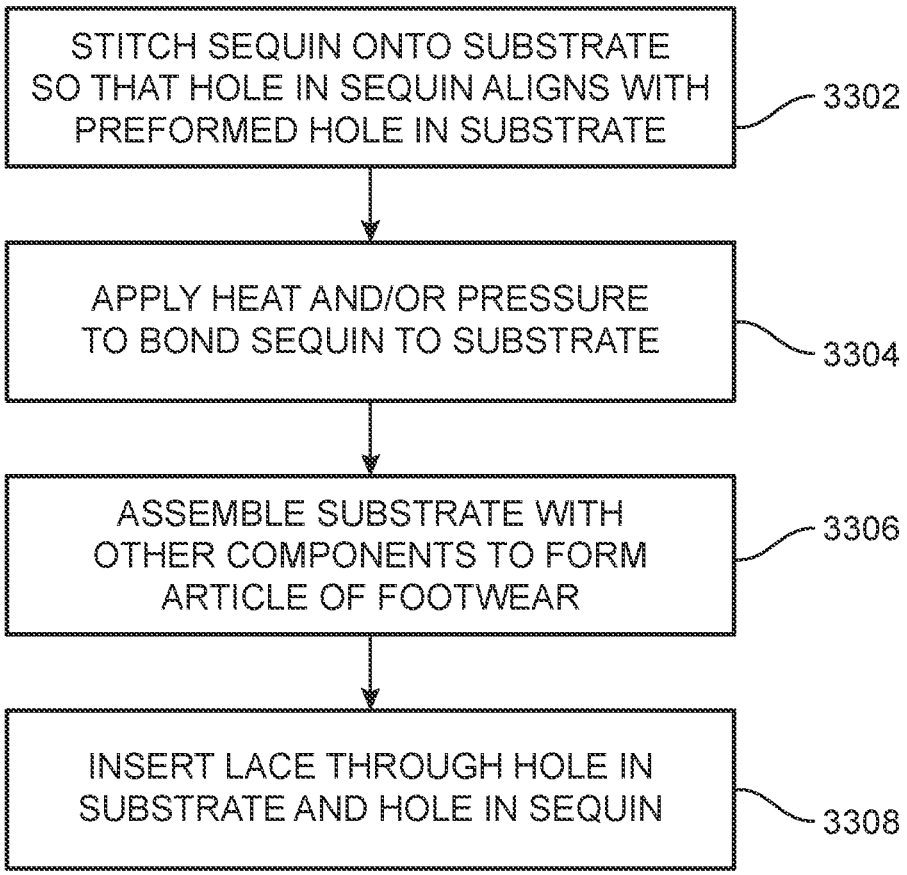
FIG. 32 is a schematic view of a process for making an article with a sequin configured as an eyelet, according to an embodiment.

FIG. 32 is a schematic view of a process for making an article with one or more sequin eyelets. In first step 3302, a sequin may be stitched onto a substrate so that the hole in the sequin is aligned with a preformed hole in the substrate. The sequin could comprise only a hot melt material portion, or could comprise two or more layers including at least one hot melt layer. In step 3304, heat and/or pressure may be applied to bond the sequin to the substrate. Next, in step 3306, the substrate may be assembled with other components to form an article of footwear. Finally, in step 3308, a lace may be inserted through the preformed hole in the substrate as well as through the hole in the sequin.

Further embodiments are possible and characterized in supplementary claims provided as an Appendix to the present application. This Appendix is herein incorporated by reference and filed with the present application.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A method of making an article of footwear, comprising:
providing a first layer of the article of footwear;
providing a second layer of the article of footwear;
attaching a first set of hotmelt sequins to the first layer in a toe region of the article of footwear;
attaching a second set of hotmelt sequins to the first layer in a lacing region of the article of footwear, wherein the first set of sequins has more sequins than the second set of sequins;
wherein each sequin in the first set of hotmelt sequins and the second set of hotmelt sequins has an approximately two-dimensional shape with a thickness that is less than a length and a width of the sequin and wherein each sequin includes an opening;
wherein attaching the first set of hotmelt sequins to the first layer in the toe region and attaching the second set of hotmelt sequins to the first layer in the lacing region comprises stitching a thread through the opening;
locating the first set of hotmelt sequins and the second set of hotmelt sequins in between the first layer and the second layer;
bonding the first layer to the second layer in the toe region of the article of footwear using the first set of hotmelt sequins; and
bonding the first layer to the second layer in the lacing region of the article of footwear using the second set of hotmelt sequins.

2. The method according to claim 1, further comprising applying heat to the article of footwear to at least partially melt the first set of hotmelt sequins into the first layer and the second layer and bond the first layer to the second layer in the toe region of the article of footwear.

3. The method according to claim 2, further comprising applying heat to the article of footwear to at least partially melt the second set of hotmelt sequins into the first layer and the second layer and bond the first layer to the second layer in the lacing region of the article of footwear.

4. The method according to claim 3, further comprising applying pressure to the article of footwear while applying heat.

5. The method according to claim 1, wherein independent movement between the first layer and the second layer is greater in the lacing region than in the toe region.

6. The method according to claim 1, wherein the first layer is an interior layer of an upper of the article of footwear and wherein the second layer is an exterior layer of the upper.

7. The method according to claim 1, further comprising forming at least one pocket between the first layer and the second layer in the lacing region.

8. The method according to claim 1, wherein attaching the first set of hotmelt sequins to the first layer in the toe region and attaching the second set of hotmelt sequins to the first layer in the lacing region comprises using an embroidery machine to stitch the thread through the opening in each sequin to secure each sequin to the first layer.

9. The method according to claim 1, further comprising:

arranging the first set of hotmelt sequins and the second set of hotmelt sequins in a dispersive gradient pattern such that sequins in the first set of hotmelt sequins are more densely arranged in the toe region of the article of footwear than sequins in the second set of hotmelt sequins in the lacing region of the article of footwear; and arranging the dispersive gradient pattern on the article of footwear such that spacing between adjacent sequins of the first set of hotmelt sequins and the second set of hotmelt sequins increases along a longitudinal direction of the article of footwear extending from the toe region to a heel region.

10. A method of making an article, comprising: embroidering a plurality of hotmelt sequins to a first layer, wherein a first set of hotmelt sequins are embroidered in a first region according to a first sequin pattern and wherein a second set of hotmelt sequins are embroidered in a second region according to a second pattern; placing a second layer against the first layer; and heating the plurality of hotmelt sequins to bond the first layer to the second layer, wherein the article is an article of footwear and wherein the first layer and the second layer are layers of an upper of the article of footwear, and wherein heating the plurality of hotmelt sequins results in the plurality of sequins melting into the first layer and the second layer in order to bond the first layer and the second layer.

* * * * *